US005666599A

United States Patent [19]

Miyasaka et al.

[11] Patent Number: 5,666,599

[45] Date of Patent: Sep. 9, 1997

[54] COLOR ELECTRO-PHOTOGRAPHIC PRINTING APPARATUS

[75] Inventors: Toru Miyasaka; Masashi Yamamoto, both of Hitachi; Nobuyoshi Hoshi, Hitachinaka; Seiji Maruo, Hitachi, all of Japan

[73] Assignee: Hitachi, Ltd., Tokyo, Japan

[21] Appl. No.: 412,122

[22] Filed: Mar. 28, 1995

[30] Foreign Application Priority Data

Apr. 6, 1994 [JP] Japan ..... 6-068295
Sep. 5, 1994 [JP] Japan ..... 6-210931

[51] Int. Cl.[6] ..... G03G 5/00; G03G 15/01; G03G 15/14

[52] U.S. Cl. ..... 399/162; 347/225; 347/261; 399/223; 399/302

[58] Field of Search ..... 355/271, 274, 355/275, 212, 210, 200, 299, 296, 302, 301, 245, 326 R; 347/261, 225; 399/116, 121, 119, 162, 164, 297, 298, 302, 308, 223

[56] References Cited

U.S. PATENT DOCUMENTS 4,870,466 9/1989 Iida ..... 355/302 X
4,901,110 2/1990 Tompkins et al. ..... 355/271 X
4,939,547 7/1990 Miyaji et al. ..... 355/245
5,164,783 11/1992 Taguchi et al. ..... 355/271 X
5,314,774 5/1994 Camis ..... 355/326 R X
5,444,515 8/1995 Haneda et al. ..... 355/210 X

FOREIGN PATENT DOCUMENTS 2-189562 7/1990 Japan .
2-213884 8/1990 Japan .

*Primary Examiner*—Shuk Lee
*Attorney, Agent, or Firm*—Antonelli, Terry, Stout, & Kraus, LLP.

[57] ABSTRACT

An intermediate transfer drum is employed and a photosensitive belt having a length equal to the outer peripheral length of the intermediate transfer drum is arranged with a vertical orientation. Developing units of the same shape are arranged on one side of the photosensitive belt, and a charging unit and a cleaner are arranged on the other side. The intermediate transfer drum is placed under or diagonally under the photosensitive belt. A transfer mechanism for transferring an image on the intermediate transfer drum to a sheet of paper is placed under or diagonally under the intermediate transfer drum. By this arrangement and construction, a small-size color electro-photographic apparatus having a size capable of easy use as a desk-top apparatus is provided, which satisfies quality of image, speed of printing, and easiness of maintenance requirements at the same time.

25 Claims, 19 Drawing Sheets

COLOR ELECTRO-PHOTOGRAPHIC PRINTING APPARATUS

BACKGROUND OF THE INVENTION

The present invention relates to an apparatus for performing color image printing, and more particularly relates to a small-size color image printing apparatus utilizing an electro-photographic process.

In the past, there has been an electro-photographic printing apparatus utilizing electro-photography as an for printing a color image using image information from a computer or the like. The use of electro-photography has a disadvantage in that it calls for a complex structure, which is difficult to handle and is large in size, because of the large number of printing processes to be carried out therein. Particularly, if the apparatus is arranged to provide developing units for four colors around a photosensitive drum, the apparatus becomes complex in that each of the developing units is required to change its structure and at the same time the diameter of the photosensitive drum becomes large. Therefore, in a conventional apparatus of this type a photosensitive body having a comparatively small diameter is employed, and at the same time a switching method using a mechanism for sliding or rotating the four developing units into an operative position is also employed. This technology is described in, for example, Japanese Patent Application Laid-Open No. 2-189562 (1990) and Japanese Patent Publication No. 2-13304 (1990). However, the apparatus having this construction is complex and not easy to handle because of the mechanism required for driving the developing units.

On the other hand, a method is proposed in Japanese Patent Application Laid-Open No. 2-213884 (1990), where a photosensitive body is formed as a belt, and three or four developing units are arranged to make use of the flat surface portion of the photosensitive belt.

However, it has been difficult for the conventional electro-photographic apparatuses to satisfy quality of image, speed of printing, easiness of maintenance and size of apparatus requirements at one time. There occurs any one or more of a degradation in the quality of the image, a lowering in speed of printing and an increase in the size of the apparatus. Therefore, although various methods have been proposed, it has not been possible to provide a high-quality-image and small-size color electro-photographic apparatus having a size capable of use as a desk-top apparatus.

SUMMARY OF THE INVENTION

An object of the present invention is to provide a small-size color electro-photographic apparatus having a size which makes it capable of easily being used as a desk-top apparatus and which satisfies quality of image, speed of printing, and easiness of maintenance requirements at one time by systematically studying printing processes of such components as a photosensitive belt, an intermediate transfer drum charging unit, an exposing unit, a developing unit, a transfer unit, a fixing unit and so on, a paper transporting path, and construction and arrangement including unitizing each of the components.

In order to attain the above object, a drum is employed as the intermediate transfer component and a photosensitive belt having a length equal to the outer peripheral length of the intermediate transfer drum is arranged on with a vertical orientation. Developing units of the same shape are arranged in one side of the photosensitive belt, and a charging unit and a cleaner are arranged in the other side. The intermediate transfer drum is placed under or diagonally under the photosensitive belt. A transfer mechanism for transferring an image on the intermediate transfer drum to a sheet of paper is placed under or diagonally under the intermediate transfer drum.

In the above construction, it is possible to get the rotating cycle of the photosensitive belt to agree with that of the intermediate transfer drum employing a photosensitive belt having a length equal to the peripheral length of the intermediate transfer drum. Therefore, it is easy to obtain sufficient accuracy of color superposition in superposing an image of each color. In the above construction, it is also possible to reduce the entire size of the apparatus by employing a photosensitive belt having a length equal to the peripheral length of the intermediate transfer drum. Further, it is comparatively easy to construct a thin developing apparatus because the photosensitive body of belt-shape is arranged vertically and the developing units are arranged in one side of the photosensitive body. Furthermore, it is possible to place the means for transferring an image to paper in a position under the intermediate transfer drum where is effective to peel off the paper because the intermediate transfer drum is placed under the photosensitive belt.

DETAILED DESCRIPTION OF THE PREFERRED EMBODIMENT

Figure 1:
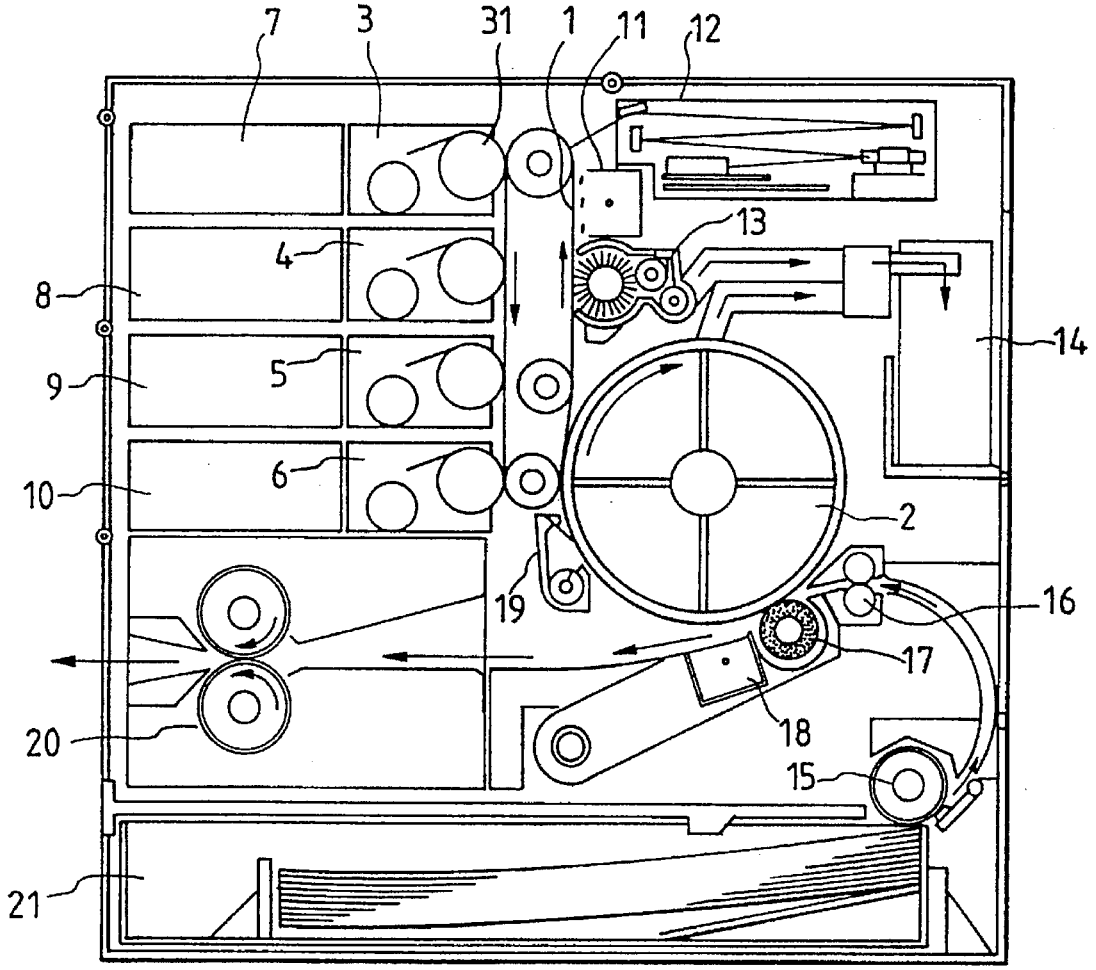
FIG. 1 is a side view showing the entire construction of an embodiment of a color electro-photographic apparatus in accordance with the present invention.

FIG. 1 is a view showing the construction of an embodiment of a small-size color image printing apparatus utilizing an electro-photographic process in accordance with the present invention.

In the beginning, an outline of the operation of each part during color image printing using the apparatus. The apparatus comprises a photosensitive belt 1 and an intermediate transfer drum 2. The rotating photosensitive belt 1 is uniformly charged by a charging unit 11. Next, laser exposing is performed by a laser exposing unit 12 according to an image pattern for the color yellow to form an electrostatic latent image. The electrostatic latent image is developed by a yellow developing unit 3, and the yellow toner image is transferred to the intermediate transfer drum 2. After transferring the first image, the photosensitive belt 1 is discharged by an eraser and cleaned by a cleaning unit 13. The cleaning unit 13 has a toner collecting box 14 in which disposed toner produced by cleaning is collected. Then, after the belt 1 is charged again, laser exposing is performed according to an image pattern for the color magenta and this electrostatic latent image is developed by a magenta developing unit 4. The magenta toner image is transferred to the intermediate transfer drum 2 so as to be superposed on the yellow toner image previously transferred.

The process is sequentially performed to form an image for the color cyan by a cyan developing unit 5 and to form an image for black by a black developing unit 6, and in this way an image composed of the four colors yellow, magenta, cyan and black is formed on the intermediate transfer drum 2. During the forming of these images, a transfer mechanism composed of a cleaning unit 19, a transfer roller 17 and a discharging unit 18 provided around the intermediate transfer drum 2 are disposed out of contact with the transfer drum 2 and hold in a stand-by condition. Then, a sheet of paper is picked from a paper tray 21 and the four color image on the intermediate transfer drum 2 is electrostatically transferred thereto. The paper after receiving the transferred image is discharged so as to be peeled off the transfer drum 2 by the discharging unit 18, and the toner of each color is heated by a fixing unit 20 so as to be melt-mixed and melt-fixed on the paper. Thus, the full-color printing is completed. After completion of transfer of the four color image to a paper, the intermediate transfer drum 2 is cleaned to remove the remaining toner by the cleaning unit 19. The disposed toner produced by the cleaning unit 19 is collected into the toner collecting box 14 in the cleaning unit 13.

The developing units 3, 4, 5, 6 have toner supplying parts 7, 8, 9, and 10, respectively, to supply the necessary amount of toner when the developing units lack toner. In the embodiment, the photosensitive belt 1 is vertically arranged as shown in FIG. 1, and the developing units 3 to 6 are vertically arranged along one side of the photosensitive belt 1. On the side reverse to the side where the developing units 3 to 6, are disposed the intermediate transfer drum 2, the cleaning unit 13 for the photosensitive belt, the charging unit 11 and the laser exposing unit 12 are arranged in that order from the bottom side. Further, under the developing units 3 to 6 and the intermediate transfer drum 2, the paper tray 21, paper transporting systems 15, 17 and the fixing unit 20 are arranged.

In the case of available paper of A4 size to A3 size, the dimension of the apparatus with the above arrangement is has a total apparatus height of 250 mm to 500 mm including a paper cassette height of approximately 40 mm, a depth of 290 mm to 400 mm when the paper discharging side for printing papers is in the front, and a width of 350 mm to 600 mm considering the space to mount a controller, a motor and so on. Accordingly, the apparatus according to the present invention has a size small enough to be placed conveniently on a table.

Construction of each the parts composing the apparatus will be described below.

In order to construct a color image printing apparatus of a type utilizing an electro-photographic process such as a laser printer, it is common to employ a method in which by providing a photosensitive body for each color, transferring and fixing an image on a printing paper after completion of each process of charging, exposing and developing can be carried out. This method has a disadvantage in that the size of the apparatus becomes large because the photosensitive bodies and the exposing units for four colors are required. There is another method in which by using one photosensitive body, a printing process of charging, exposing and developing for each color is repeated three to four times to form an image by superposing images of the basic colors of yellow, magenta and cyan (black is used in a case of four colors), and then the image formed is transferred and fixed on a printing paper. There are further methods where the basic process is composed of up to transferring images to a printing paper where a full-color image is formed by superposing an image of each color on the printing paper and fixing it, and in this method, after developing an image of one color, similar to the present invention, the image is transferred to an intermediate transfer drum to superpose images on the intermediate transfer drum, and then, after completion of the superposing, the final image is transferred and fixed on a printing paper. Each of the methods has its merits and demerits. Particularly, the method using an intermediate transfer drum is superior in obtaining a high quality color image because it is hardly affected by the kinds of printing papers and/or change in the environment (especially, printing papers are apt to be affected by a change in the environment).

Description will be made regarding the apparatus below.

The electro-photographic process according to the present invention requires various printing and transferring processes, such as a charging process for charging a photosensitive belt of photoconductive material, an exposing process, a developing process, a transferring process, a cleaning process and a fixing process. Accordingly, there is an disadvantage in that the size of the apparatus can become large. In order to eliminate this disadvantage, according to the present invention, a small-size and high speed printing are realized by minimizing the size of the unit provided for each process and by improving the structural arrangement of each unit.

The embodiment according to the present invention shown in FIG. 1 has a four-rotation type photosensitive belt, and a printing speed of 5 pages (A4 size printing paper) per minute for full color image printing and 20 pages per minute for mono-color printing. However, it is possible to increase the printing speed further with this construction. That is, the printing speed for mono-color by the construction shown in FIG. 1 is very high, from several tens of pages per minute to several hundreds of pages per minute. Therefore, the apparatus has a high printing speed sufficient to attain a speed of several pages per minute to several tens of pages per minute for full-color printing even if the photosensitive body is rotated 3 to 4 cycles for color printing. This speed is faster than the speed in other types of color image printing apparatus such as the ink-jet type or thermosensitive type, and represents an acceptable printing speed for a small-size color image printing apparatus for disk-top use.

A color image has a larger amount of information than a mono-color image. Since a color image printing apparatus is required to have high image quality, the required printing density needs to be more than 400 to 600 dpi (unit indicating number of dots per one inch). In a case of a paper size of A4 and 400 dpi, the number of dots becomes approximately 15,500,000. By taking a tone of 3 colors and 8 bits into consideration, the amount of information becomes 46 M Byte. Thereby, in a present color printer, it takes several minutes to several tens of minutes to convert and transmit data for image printing. Although the attempt will be made to lessen the conversion and transmission time in the future, it is sufficient that the printing speed of a color image printing apparatus is several pages per minute to several tens of pages per minute, as described above, unless the conversion and transmission speed is improved by several hundred times to several thousand times as the fast as present speed. Also, from this point of view, it is effective for a small-size color photo-graphic apparatus of the desk top type to employ a method wherein a single photosensitive body is rotated through plural cycles. The details regarding printing speed will be described later.

As for a method of superposing each of the basic color images, in accordance with the present invention as described above, after completion of the forming a toner image of one color on the photosensitive belt 1, the toner image is transferred on the intermediate transfer drum 2, and a toner image of the next color is formed on the photosensitive belt 1 and the toner image formed is sequentially transferred and superposed on the same intermediate transfer drum 2, and then after completion of superposing of the toner images of all colors on the intermediate transfer drum 2, the toner image is transferred and fixed to a sheet of printing paper.

As for the shapes of the photosensitive medium and the intermediate transfer medium, a construction using a belt and a construction using a drum can be considered. Since the shape of the belt can be freely selected, there is an advantage to the belt in that the belt has a very small limitation against various printing and transferring process units arranged around it. However, the belt is apt to cause a snaking movement while being driven, requires a mechanism such as tensioner for always applying a certain tension to the belt, and is apt to slip while being driven. Therefore, it is required to provide protuberances in both edge portions of the belt, and to select materials for the driving shaft and for the inside surface of the belt so as to pet sufficient frictional drive. On the other hand, when the photosensitive body is formed as a drum, it has a simple construction and is easy to drive. However, there is a disadvantage in that the drum has a large limitation against various printing and transferring process units arranged around it.

Around the photosensitive body, it is required to arrange a charging unit, an exposing unit, a cleaner, an eraser, and an intermediate transfer drum, as well as four developing units. In a case where both of the intermediate transfer medium and the photosensitive body medium are formed as drums, it is required to make the drum diameter of the intermediate transfer medium the same as that of the photosensitive body medium. In order to avoid this, there is a method where a number of developing units accessing the photosensitive medium is limited to one at a time and the developing units are exchanged according to the color using a sliding mechanism or a rotating mechanism. However, an exchanging mechanism is necessary and consequently it is inevitable that the apparatus becomes large. In a case where plural fixed developing units are arranged around the drum, the developing units should be made so as to have a different construction from one other. From the viewpoint of decreasing production cost and simplifying construction, it is preferable that the three or four developing units used have the same construction. Therewith, it is important for a small-size color electro-photographic printer to employ a construction where the photosensitive medium is formed in a belt-shape and in which developing units having the same construction are arranged in parallel.

Description will be made concerning the intermediate transfer medium below.

Among the process units arranged around the intermediate transfer medium, there are not plural units having the same construction as the process units (developing units in the case of the photosensitive medium) around the photosensitive medium. The number of process units around the intermediate transfer medium is less than the number of process units around the photosensitive medium. Further, when the photosensitive medium is formed in a belt-shape as described above, it is preferable to form the intermediate transfer medium in a drum-shape so as to provide a construction and driving capability which are more stable and simpler than provided by a belt-shape component. Therefore, in the present invention, the construction of the combination of an intermediate transfer drum 2 and a photosensitive belt 1 is employed.

In order to make a color electro-photographic apparatus small, it is necessary to make the intermediate transfer drum 2 and the photosensitive belt 1 small. In using the intermediate transfer drum as proposed by the present invention, the peripheral length of the drum must be longer than the length of the paper to be printed in the direction of transportation. When paper transportation is for a laterally oriented paper (shorter side direction) of A4 size, the required length of the periphery of the intermediate transfer body is longer than 210 mm. And, when transportation is for a longitudinally oriented paper (longer side direction) of A4 size, the required length of the periphery of the intermediate transfer medium is longer than 297 mm. In a case of an apparatus capable of printing an A3 size paper, for transportation of a longitudinally oriented paper, the required length of the periphery of the intermediate transfer body needs to be longer than 420 mm. From the above results, in a case where the intermediate transfer medium should be a drum, the diameter of the drum is larger than 67 mm (=210/3.14) in a case of transportation of a laterally oriented paper of A4 size, larger than 95 mm (=297/3.14) in a case of transportation of a longitudinally oriented paper of A4 size, and larger than 143 mm (=420/3.14) in a case of transportation of a laterally oriented paper of A3 size.

Figure 2:
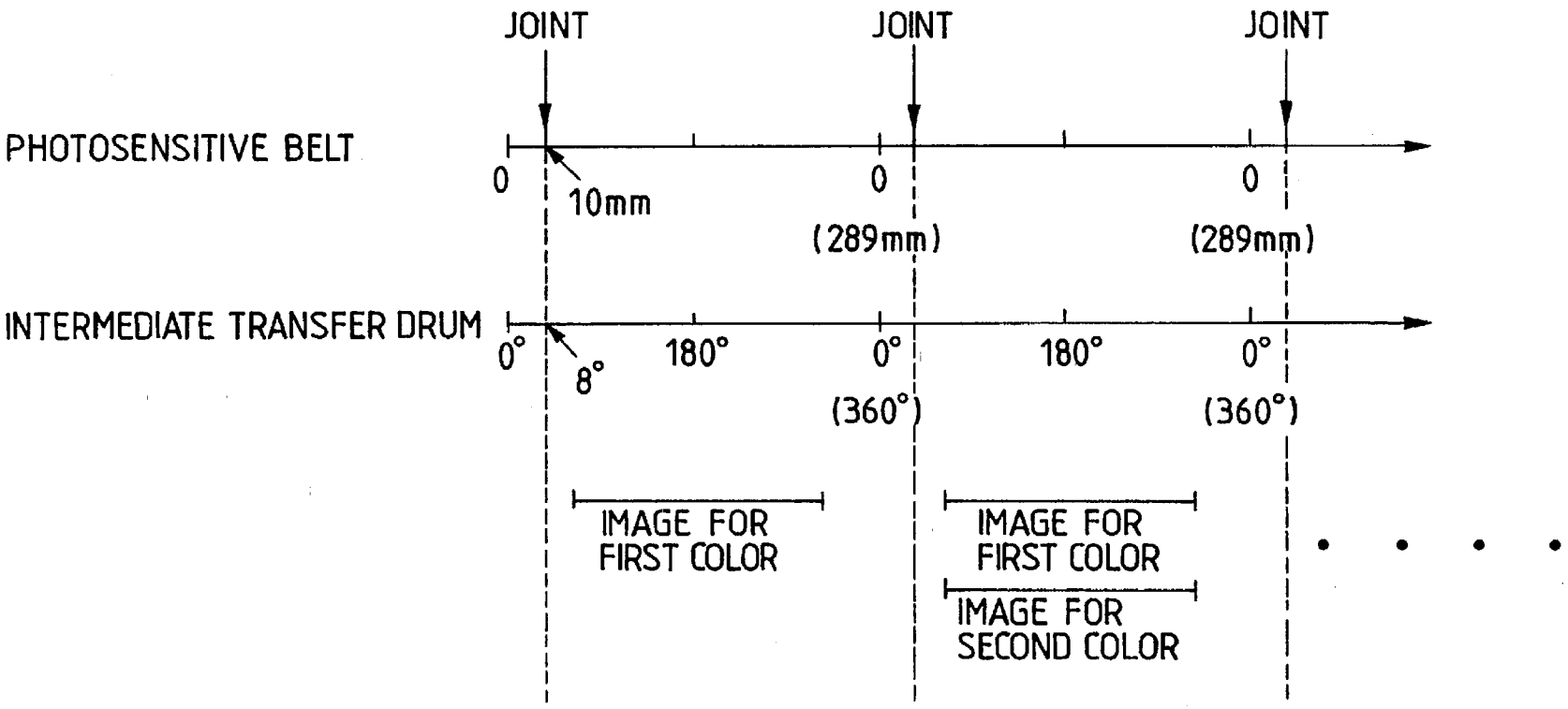
FIG. 2 is a diagram for explaining the relationship between the outer peripheral length of an intermediate transfer body and the outer peripheral length of a photosensitive belt.
Figure 3:
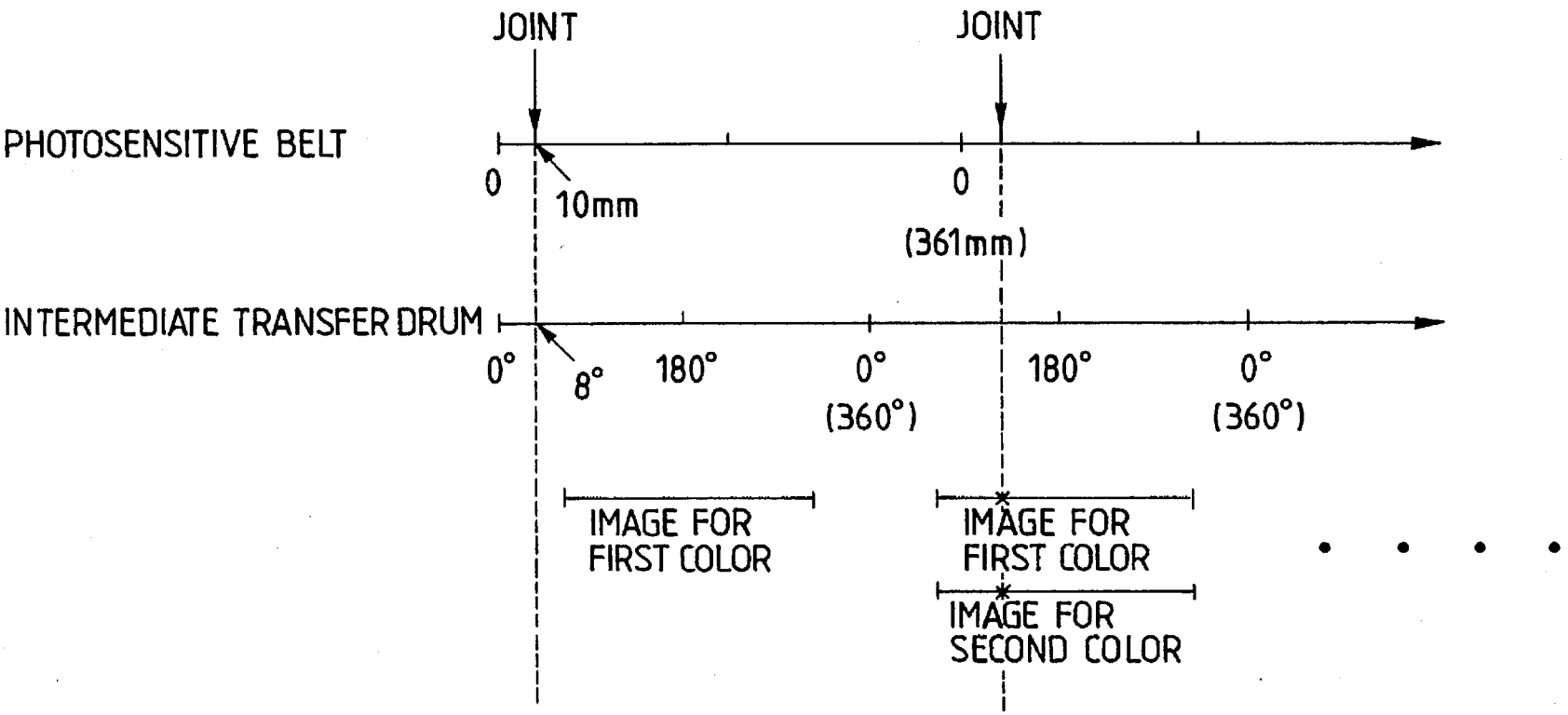
FIG. 3 is a diagram for explaining the relationship between the outer peripheral length of an intermediate transfer body and the outer peripheral length of a photosensitive belt.

The photosensitive belt 1 has a joint because it is formed by bonding a photosensitive medium of a sheet-shape into a loop-shape. In order to print while avoiding the joint of the photosensitive belt, it is necessary that the position on the intermediate transfer drum 2 contacting the joint of the photosensitive belt must be the same in every rotation of the photosensitive belt 1, the peripheral length of the intermediate transfer drum 2 must be longer than the above calculated value by the joint region of the photosensitive belt. Therefore, it is necessary that the photosensitive belt 1 has a length which is an integral number of times as long as the peripheral length of the intermediate transfer drum 2. FIG. 2 is a diagram showing the positional relationship of the surface between the photosensitive belt and the intermediate transfer drum in the case where the rotating period of the intermediate transfer drum 2 and the rotating period of the photosensitive belt 1 are the same (in a case of one time rotation). In FIG. 2, letting the joint position of the photosensitive belt be position of 0 (zero) degree, by taking ±10 mm as the joint region, it is possible to make the image of each color agree with one another without overlapping with the joint portion. FIG. 3 shows in a case where the length of the photosensitive belt 1 is longer than the peripheral length of the intermediate transfer drum 2. As shown in the figure, when an image for a second color is to be superposed on an image for a first color which has been transferred to the intermediate transfer drum, the image for the second color has to be formed on the joint portion of the photosensitive belt and accordingly a clear image cannot be obtained. In order to avoid the above trouble by establishing agreement of the image forming position on the photosensitive belt 1 with the same position, it is required to individually control the rotations of the photosensitive belt 1 and the intermediate transfer drum 2 and to transfer an image after proper positioning by changing the rotating speed of the intermediate transfer drum 2. This is not suitable for a small-size apparatus because of the resulting complexity in construction and control.

Although it is possible to make a photosensitive belt seamless by applying photosensitive material to a joint portion, the photosensitive material on the joint portion is apt to be deteriorated by a large number of rotations. Therefore, it is preferable to use a photosensitive belt in transferring toner images while avoiding the joint portion. That is, the length of the photosensitive belt 1 is preferably an integral number of times as long as the peripheral length of the intermediate transfer drum 2.

Even in a case of using a seamless photosensitive belt in which deterioration does not occur in the joint portion, shifting occurs between the rotating periods of the photosensitive belt 1 and the intermediate transfer drum 2 unless the length of the photosensitive belt 1 is an integral number of times as long as the peripheral length of the intermediate transfer drum 2. It is necessary to provide positioning control when superposing toner images of different color, and it is known that the accuracy in the positioning is low.

In a case where the length of the photosensitive belt 1 is not an integral number of times as long as the peripheral length of the intermediate transfer drum 2, when a flaw or a deteriorated part is formed on the surface of the photosensitive belt, the flaw or the deteriorated part appears in different positions for each of the colors because shifting occurs between the rotating periods of the photosensitive belt 1 and the intermediate transfer drum 2. Therefore, the number of positions affected by the flaws and the deteriorated portions in a final toner image becomes large compared to a toner image where the length of the photosensitive belt 1 is an integral number of times as long as the peripheral length of the intermediate transfer drum 2. In a case where the length of the photosensitive belt 1 is an integral number of times as long as the peripheral length of the intermediate transfer drum 2, even when the photosensitive belt has a part deteriorated in its characteristic on the surface, the deteriorated part shows only one abnormal density region since the abnormal density regions for all colors due to the deteriorated part appear in the same position in the toner image. However, there is a disadvantage in that the color tone of the toner image changes when the toner image of each color is displaced. For this reason, it is preferable that the length of the photosensitive belt 1 is an integral number of times as long as the peripheral length of the intermediate transfer drum 2.

Accordingly, the diameter of the intermediate transfer drum 2 for performing A4 size paper printing is preferably approximately 70 mm to 120 mm, and the diameter for performing A3 size paper printing is preferably approximately 150 mm. Taking the peripheral length of the photosensitive belt 1 to be one time of rotation of the peripheral length of the intermediate transfer drum 2, the length of the photosensitive belt 1 for performing A4 size paper printing becomes approximately 220 mm to 380 mm, and the length for performing A3 size paper printing becomes approximately 470 mm. Taking the peripheral length of the photosensitive belt 1 to be two times as long as the peripheral length of the intermediate transfer drum 2, the length of the photosensitive belt 1 for performing A4 size paper printing becomes approximately 440 mm to 760 mm, and the length for performing A3 size paper printing becomes approximately 940 mm. As described above, in a case of taking the peripheral length of the photosensitive belt 1 to be two times as long as the peripheral length of the intermediate transfer drum 2, the photosensitive belt 1 is required to have a substantially long length. Thereby, in order to realize a small-size color electro-photographic apparatus, it is important that the peripheral length of the photosensitive belt 1 is equal to the peripheral length of the intermediate transfer drum 2.

Figure 4:
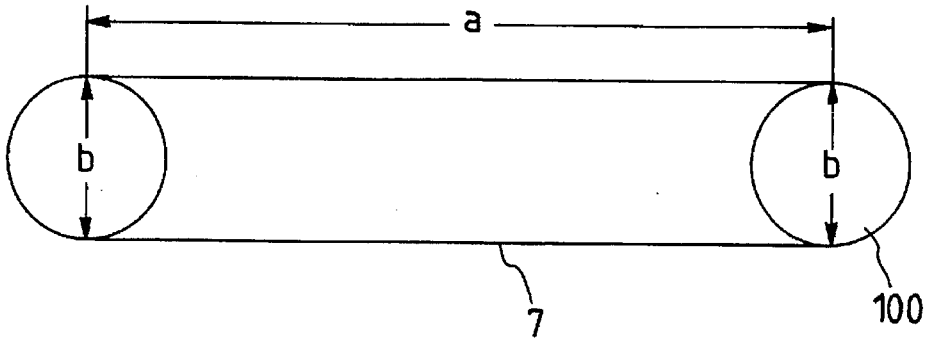
FIG. 4 is a diagram for explaining the dimensions of various parts when a photosensitive belt is stretched over rollers.

When the diameter of the rollers 100 over which the photosensitive belt 1 is stretched too small, deterioration of the photosensitive belt is accelerated. Therefore, the diameter b of the roller 100 is required to be at least 10 mm to 20 mm or more. In a case where the photosensitive belt 1 is stretched over two rollers 100 having a diameter of 200 mm, as shown in FIG. 4, the length a of the straight portion in the photosensitive belt 1 becomes approximately 78 mm to 160 mm on one side (in a case of A4 size printing paper) and approximately 200 mm (in a case of A3 size printing paper).

In a case of arranging four developing units 3 to 6 of the same type on one side of the photosensitive belt 1, the width of one developing unit is required to be approximately 25 mm to 50 mm at a maximum. The width for A3 size paper becomes approximately 65 mm or less. In considering the gaps between the developing units, it is clear that a developing unit having a very thin width is required.

As for the arrangement of the developing units 3 to 6 with respect to the photosensitive belt 1, it possible to arrange them under or above the photosensitive belt 1 rather than arranging them beside the belt, as shown in FIG. 1.

In a developing unit using a two-component developing method, the developing agent composed of a toner and a carrier has to be recirculated between a mixing chamber for charging the developing agent and a developing roll. Therefore, in a case where the developing units are arranged above or under the photosensitive belt, it is required to provide a mechanism to transport the developing agent upward against gravity when the developing agent is fed to or collected from the roll.

For example, in a developing unit arranged above the photosensitive belt 1, it is comparatively easy to feed the toner from a toner chamber to a mixing chamber and to transfer the developing agent from the mixing chamber to the developing roll because these operations are performed in the direction as some gravity. However, removing of the developing agent from the developing roll and transporting the developing agent to the mixing chamber is performed in a direction opposite to gravity. Therefore, it is difficult to collect the developing agent removed from the developing roll using a blade on the developing roll, into the mixing chamber, and consequently the toner is accumulated in a particular position inside the developing unit.

For this reason, the construction of a conventional developing unit is as follows. Toner on a developing roll is transferred to a magnet roll placed above, and is transported first above and then is separated by a blade so as to be returned into a mixing chamber provided in the side surface of the developing roll. Therefore, with this construction, since the thickness of the developing unit becomes substantial, it is difficult to conform the thickness of this developing unit with the thickness of the developing unit described above.

On the other hand, in the arrangement method shown in FIG. 1, there is no need to provide for transporting developing agent or toner upward against the force of gravity. Therefore, it is possible to return the developing agent which is not consumed in the photosensitive body to a mixing chamber 34 by scraping the developing agent from a developing roll 31 with a blade 33 and to transport the developing agent to the developing roll 31 with a mixing paddle (mixing roll) 32. In a case where plural mixing rolls 34 are arranged in order to mix the developing agent well, the mixing rolls may be arranged in parallel to one another without increasing the thickness of the developing units, which is different from the case where the developing units are arranged above or under the developing roll. Further, the toner can be comparatively easily supplied from the side surface to the mixing chamber In FIG. 5, the diameter of the developing roll 31 is 20 mm, and the total thickness of the developing units is 30 mm. The mixing chamber 34 is arranged under and beside the developing roll 31 and toner is supplied to the under side of the developing roll 31. The toner on the developing roll 31 after developing is scraped with the blade 33 so as to be returned to the mixing chamber 34. In the construction of one embodiment of the apparatus in FIG. 1 according to the present invention, the developing units 3 to 6 and the photosensitive belt 1 are formed in the unit and the toner containing chambers 7 to 10 are formed in another unit in order to maintain an accurate gap between the developing units 3 to 6 and the photosensitive belt 1, to make handling of the developing units and the photosensitive belt 1 easy and to make supplying toner easy. In the embodiment of the developing unit 3 in FIG. 5, a connecting portion for connecting a developing unit 3 to a toner containing chamber unit 7 is provided on the side surface of the mixing chamber. The connecting portion has a cover 35 opening toward the inside of the container to allow it be connected easily and to prevent toner from spilling before and at the connecting time.

Figure 5:
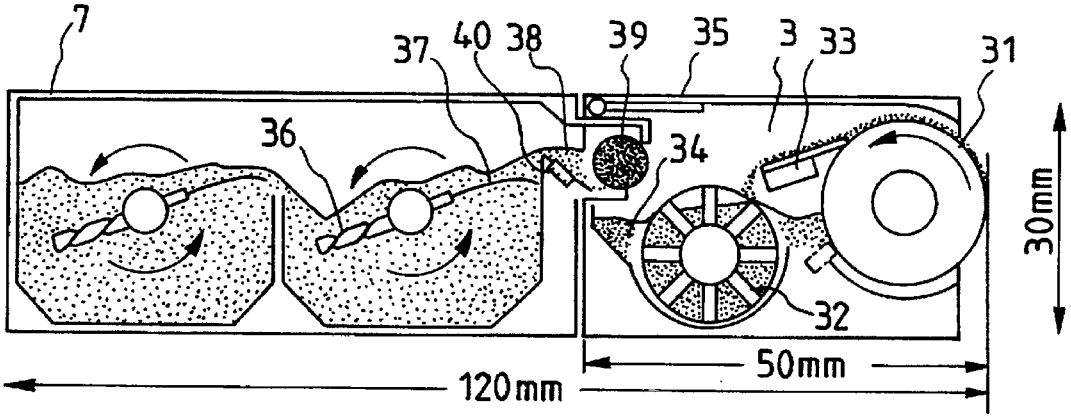
FIG. 5 is a side view showing the connecting state between a toner containing chamber and the main body of a developing apparatus.

FIG. 5 shows the construction of the toner containing chamber unit 7 to be connected to the developing unit 3. In the toner containing chamber, a rotating wing 37 formed of a PET (polyethylene terephthalate) film or the like having a thickness of approximately 100 μm is provided. The toner is transported to the developing unit side by rotating the rotating wing 37. In order to prevent the toner from sticking inside the toner case, a metallic comb-shaped rotating body 36 is provided in the reverse direction of the rotating wing. In order to accomodate a large amount of toner in the thin space, in the embodiment shown in the figure, two toner chambers having a rotating wing 37 formed of a PET film and the comb-shaped rotating body 36 are arranged in series. In the supplying port for supplying toner to the developing unit 3, there are a groove 38 for storing toner and an exit gate formed of a foamed roller 39. The toner stored in the groove 38 in the exit portion by the rotating wing 37 is transported into the mixing chamber 34 inside the developing unit 3 by rotation of the foamed roller 39. The rotation of the foamed roller 39 is controlled for supplying toner so that the output signal from a toner density sensor (not shown) inside the mixing chamber of the developing unit becomes a pre-set value. The control is performed by a controller in the main body side of the color image printing apparatus shown in FIG. 1. Insufficient toner in the toner containing chamber is detected by a toner sensor 40 provided near the foamed roller 39 in the toner exit port. A controller (not shown) in the main body of the color image printing apparatus detects the absence of sufficient toner and generates a toner lacking signal to request an operator to supply toner.

The volume of the toner containing chamber unit 7 may be required to be large enough to print at least 1,000 sheets of color images having an image density of approximately 10% for each color taking the frequency of toner supplying into consideration. The area of an A4 size paper is 623.7 $cm^2$ (=21 cm×29.7 cm), and the toner amount required for sufficient density is commonly set to approximately 1 $mg/cm^2$. The consuming amount of toner per one sheet of A4 size paper becomes approximately 0.06 g/sheet for each color. Thereby, in order to print 1,000 sheets, the amount of approximately 60 g of toner is required. Since the density of toner loaded is approximately 0.3 to 0.4 $g/cm^3$, the volume of the toner is approximately 150 to 200 $cm^3$ (=60/0.3~0.4). In considering stable transportation of the toner and prevention of toner sticking inside the toner containing chamber, the volume for the toner containing chamber is generally required to be approximately two to three times as large as the calculated volume. Therefore, the toner containing chamber is required to have a volume of approximately 300 to 600 $cm^3$. In the toner containing unit 7 in the embodiment shown in FIG. 1, assuming the height inside the toner containing chamber is approximately 2.5 cm, and the width in the direction of the developing roll shaft is approximately 28 cm, the width in the direction perpendicular to the developing roll shaft becomes 4.3 to 8.5 cm. The toner containing chamber unit 7 in the embodiment shown in FIG. 1 and FIG. 5 is 70 mm wide, and the total width of the developing unit is 120 mm.

In general, the size of a developing unit of non-magnetic one-component developing type can be made small comparing to that of a developing unit of two-component developing type. The developing unit of non-magnetic one-component developing type has no mixing chamber since the developing agent is charged with a blade or the like. Thereby, the developing unit can be comparatively easily arranged above the photosensitive belt 1. However, in a construction where the developing unit is arranged above the photosensitive belt, independently of whether it is a one-component developing type or two-component developing type, such arrangement is not preferable since the developing agent is apt to spill in, the side of the photosensitive belt. On the other hand, the construction where the developing unit is arranged under the photosensitive belt, is difficult to construct, since toner has to be transported against the force of gravity to supply toner to the developing roll even for a unit of non-magnetic one-component developing type. Further, in the developing unit arranged under the photosensitive belt, there is a possibility that the toner on the photosensitive belt falls in the developing unit for another color to be mixed therewith. From this viewpoint, in a construction where multi-color printing is performed by rotating the photosensitive belt in plural cycles and by sequentially switching the developing units, it is effective to employ a construction where the developing units are arranged beside the photosensitive belt as shown in FIG. 1.

Figure 6:
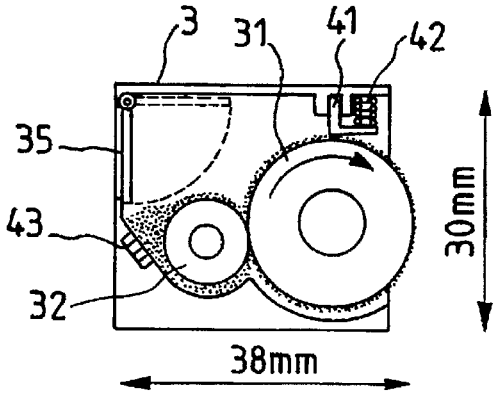
FIG. 6 is a side view showing the construction of a nonmagnetic one-component developing apparatus mountable in the color image forming apparatus in FIG. 1.

FIG. 6 shows the construction of a non-magnetic one-component developing unit which can be employed in a color image forming apparatus. A restricting blade 41 formed of an elastic blade is provided on the top surface of a metallic developing roll 31. There is provided a mixing roll 32 for supplying toner to the developing roll 31 in the back of the developing roll 31. There is a connecting portion for connecting to the toner containing unit in the upper side of the mixing roll 32. The same type unit as the aforementioned toner containing unit 7 shown in FIG. 5 can be used as a toner containing unit. A decrease in the amount of toner is detected by the output from a toner sensor provided in a part of the wall surface contacting the mixing roll 32 inside the developing unit 3, and toner is supplied from the toner containing unit 7. In the embodiment shown in FIG. 6, the width of the developing unit in a direction perpendicular to the developing shaft is approximately 40 mm.

Figure 7:
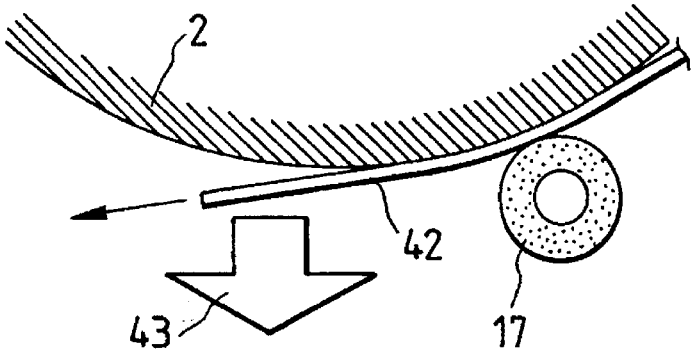
FIG. 7 is a detail view for explaining the effect of gravity in a transfer portion.

In a case where four developing units (3 to 6) having a thickness of approximately 30 to 40 mm are arranged in the straight region on one side of the photosensitive belt 1 stretched vertically, other printing and transferring process units such as a charging unit 11, a laser exposing unit 12, a photosensitive body cleaner 13, an erase lamp 325 and an intermediate transfer drum 2 can be arranged on the other side of the photosensitive belt 1. It is necessary to provide an intermediate transfer body cleaner 19 and an image transfer roller 17 for printing paper for the intermediate transfer drum 2. FIG. 7 shows an operation for transfer of an image from the intermediate transfer drum 2 to paper. In the figure, the transfer roller 17 is placed under the intermediate transfer drum 2, and when the printing paper 42 is passed through between them a toner image is transferred to the printing paper 42. Since it is difficult for a small-size apparatus to provide a mechanism for peeling the printing paper off the drum using a sucking method or the like, it is preferable for gravity to act on the paper in the direction of peeling as shown by the arrow 43 in FIG. 7, for peeling the paper off the drums after transferring of the image. From this viewpoint, it is preferable that transferring from the intermediate drum to the paper and the position of peeling the printed paper off the drum are performed at the bottom side of the intermediate transfer drum 2.

From the reasons described above, in the embodiment of the apparatus according to the present invention shown in FIG. 1, the length of the straight portion of the photosensitive belt in the developing unit side is set to 100 mm, and the diameters of the inner rollers 100 of the photosensitive belt 1 are set to 23 mm and 18.4 mm. The diameter of the intermediate transfer drum 1 is 92 mm. In order to make the rotating fluctuation period agree with that of the intermediate transfer drum, the diameters of the inner rollers 100 of the photosensitive belt 1 are set to one-fourth and one-fifth of 92 mm.

Further, for the reasons described above, in the embodiment of the apparatus according to the present invention shown in FIG. 1, the photosensitive belt 1 is developed from the side, the photosensitive belt 1 being arranged above and on one side of the intermediate transfer drum 2 while being vertically stretched long because of necessity to arrange the transferring image to paper and the peeling means under the intermediate transfer drum 2, the transferring and peeling means being arranged under the intermediate transfer drum 2.

Figure 8:
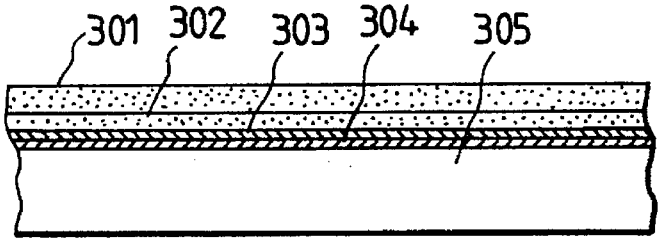
FIG. 8 is a partial sectional view showing the details of a photosensitive belt portion.

FIG. 8 is a view showing the detailed construction of an embodiment of a photosensitive belt 1 according to the present invention shown in FIG. 1. The photosensitive belt 1 is formed by vapor-depositing aluminum on a PET film 305 (polyethylene terephthalate film) having a thickness of 150 μm and applying a photosensitive material on it. The photosensitive belt has an aluminum vapor-deposited layer 304 on a PET film having a thickness of 150 μm, and above the layer 304 there is an insulator layer 303 for holding a withstanding voltage during a non-exposing time of photosensitive body. A further negative chargeable organic photosensitive body composed of a charge generating layer 302 and a charge transferring layer 301 are applied on the layer 303. Since the layer thickness of the portion of the photosensitive body 306 is approximately 20 μm, the total thickness of the photosensitive belt 1 becomes approximately 170 μm. Strictly speaking, the diameters of 23 mm and 18.4 mm of the inner rollers 100 for supporting the photosensitive belt 1 as described above are formed smaller by this belt thickness.

In the edge portions in the width direction, there are provided protrusions made of a rubber material having a width of approximately 1.5 mm and a thickness of approximately 0.5 mm. The inner rollers 100 inside the photosensitive belt 1 are formed to have taper portions at both edge portions to prevent the photosensitive belt 1 from snaking with the protrusions of the photosensitive belt and the taper portions of the inner rollers 100 inside the photosensitive belt 1.

Figure 9:
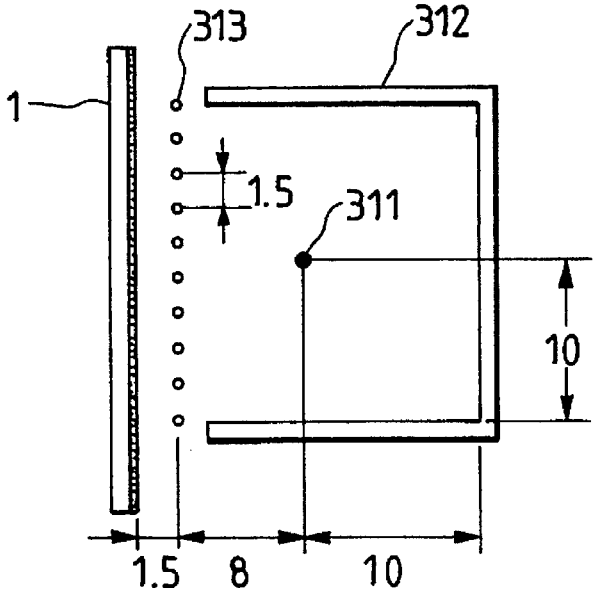
FIG. 9 is a view showing the details of the construction of a charging unit.

FIG. 9 is a view showing, the detailed construction of an embodiment of a charging unit according to the present invention as shown in FIG. 1. The charging unit is a scorotron charger having a discharge wire 311, a shielding case 312 and a grid wire 313. A tungsten wire plated with gold is used as the discharge wire 311 so that it is not deteriorated by the discharge. The diameter of the discharge wire is moderate to as to be easy to handle, not too thin and not too thick. The discharge wire in the embodiment is a tungsten wire having a diameter of 60 μm with gold plating of a thickness of 3 μm. In general, the diameter of the discharge wire is preferably 40 to 100 μm. When the distance between the shielding case 312 and the discharge wire 311 is small, an abnormal discharge is apt to take place due to vibration during discharge. When the distance is large, the discharge voltage becomes high. A proper distance between the shielding case 312 and the discharge wire 311 is approximately 10 mm, and the total width of the discharge unit, therefore, becomes approximately 20 mm. As for the distance between the grid wire 313 and the surface of the photosensitive belt 1 and the pitch between the grid wires 313, it is known that there is a certain relationship in order to obtain an effective charging characteristic and control characteristic that are compatible with each other. That is, it is proper that the pitch between the grid wires is equal to the gap between the photosensitive body and the grid. Therefore, in this embodiment, the pitch between the grid wires is set to 1.5 mm, and the gap between the photosensitive belt and the grid wire is set to 1.5 mm. The distance between the photosensitive belt and the discharge wire in this embodiment is approximately 8.5 mm. The voltage applied to the grid wire is set to 500 V under the charged voltage of the photosensitive belt of 500 V as a target voltage. Voltage applying means for the grid is easily constructed by employing high Zener diodes, but a negative variable voltage power source is required when the charged voltage of the photosensitive belt is necessary to be changed.

In this embodiment, the process speed (moving speed of the photosensitive body) is 95 mm/s, the printing paper used is A4 size, and the paper is transported in a direction parallel to its short side direction. The surface area of the photosensitive belt charged by the charging unit 11 every second is approximately 285 $cm^2$. The electrostatic capacitance of the organic photosensitive belt having a thickness of 20 μm as described above is approximately $2.0\times10^{-10}$ $F/cm^2$. The electrostatic capacitance of the surface area of the photosensitive belt to be charged in a second is $5.7\times10^{-8}$ F, and the charged voltage on the surface of the photosensitive belt is assumed to be 500 V. Then, the required current to be supplied to the surface of the photosensitive belt is $2.85\times10^{-5}$ A, that is, 28.5 μA. In a charging unit having such a construction, it is necessary to supply a large amount of current to the grid to stabilize the voltage in the surface of the photosensitive belt. By assuming that the grid current is approximately three times as much as the current required by the surface of the photosensitive belt, the amount of the current flowing to the surface of the photosensitive belt and the grid is set to approximately 120 μA. In the above construction, a current approximately three times as much as this amount of current flows to the shielding case 312. Therefore, the amount of the corona discharge current is approximately 500 μA. This value of current is within a range obtainable by applying a voltage of 5 to 7 kV to the single corona discharging wire 311 in the above construction. In the embodiment of the apparatus shown in FIG. 1, the value of the current is obtained by applying a voltage of 5.8 kV.

A roller charging mechanism may be provided within the installed space of this charging unit.

Figure 10:
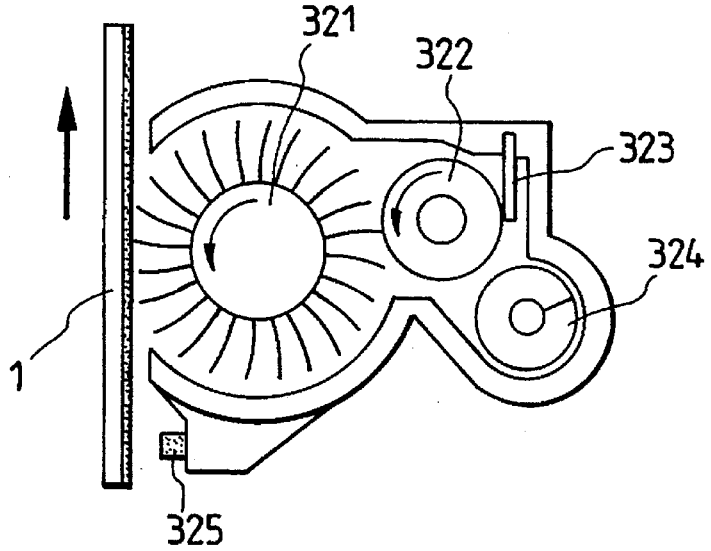
FIG. 10 is a side view showing the details of the construction of a photosensitive body cleaner.

FIG. 10 shows the construction of a photosensitive belt cleaner 13 used in the embodiment according to the present invention shown in FIG. 1. Since the photosensitive belt 1 in the embodiment is arranged in the vertical direction, the photosensitive belt at the position of the cleaner moves in the vertical direction. As for another method of cleaning the photosensitive belt 1, one of the simplest constructions is where an elastic blade is pushed against the belt. However, in the method of such type, the toner scraped off falls in the direction of gravity. Therefore, when such a cleaning method is used in the apparatus of this construction having a vertically extending photosensitive belt, there is a large possibility of toner leaking out of the cleaner.

Therewith, the embodiment employs a brush cleaning method as shown in FIG. 10. This method employs a conductive cleaning brush 321 rotating in the direction opposite to the moving direction of the photosensitive belt 1 to mechanically scrape the toner and electrostatically attract the toner by applying a voltage higher than the voltage on the surface of the photosensitive belt 1 to the conductive cleaning brush 321. In the construction of the embodiment, a voltage of approximately 600 V is applied to the base aluminum layer 304 in the photosensitive belt 1 as a base voltage. Therefore, the cleaning brush 321 in the photosensitive body cleaner 13 is grounded. The reason why the voltage of 600 V is applied to the base aluminum layer 304 in the photosensitive belt 1 as the base voltage will be described in detail later in connection with the construction of the intermediate transfer drum. The photosensitive belt cleaner 13 has a metallic roller 322 in the back of the cleaning brush 321, and is subjected to a positive voltage. Thereby, the toner scraped by the cleaning brush 321 is transferred to the metallic roller 322. A blade 323 is arranged adjacent to the metallic roller 322 to scrape down the attaching toner. The scraped toner is transported to the disposed toner collecting box 14 of FIG. 1 using a screw transporting mechanism 324.

In the apparatus of the embodiment according to the present invention as shown in FIG. 1, the diameter of the cleaning brush 321 is approximately 20 to 25 mm which is large enough to clean the photosensitive belt. The diameter of the metallic roller 322 placed behind the brush 321 is approximately 10 mm. Cleaning is easily performed if the surface of the photosensitive belt is sufficiently discharged before cleaning. Therefore, in this apparatus, under the cleaner there is provided a discharging mechanism 325 utilizing an LED array which is incorporated in the cleaner to make handling and assembling easy.

Figure 11:
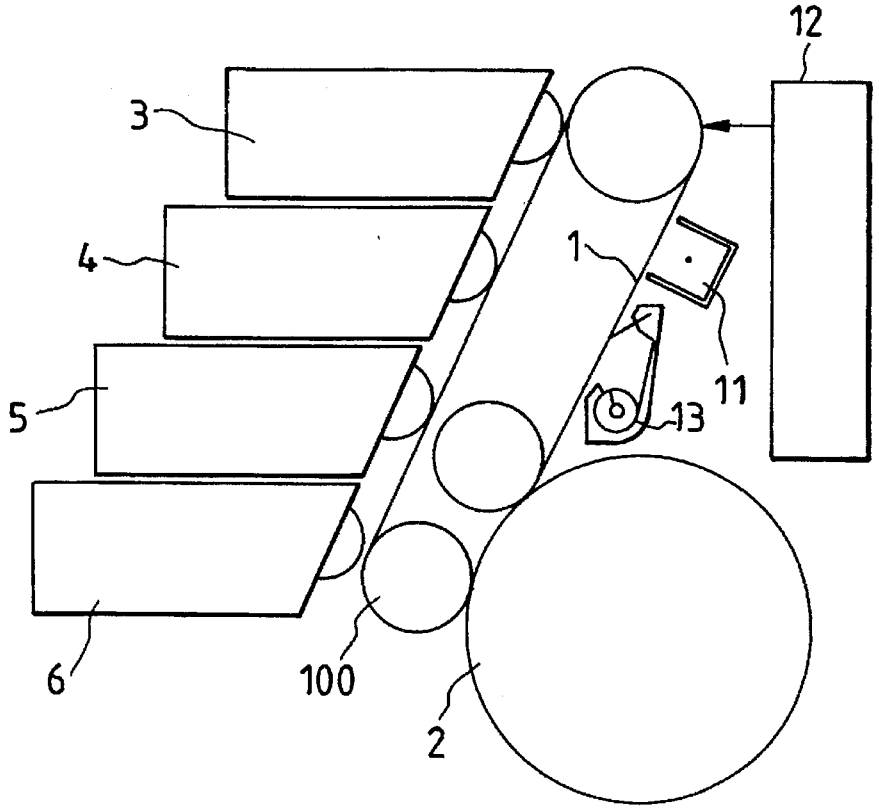
FIG. 11 is a side view showing an arrangement for tilting a photosensitive belt.

The brush cleaner 321 is used in the apparatus of the embodiment in FIG. 1 according to the present invention because the photosensitive belt 1 is stretched vertically. However, in a construction where the photosensitive belt is stretched at an angle to the vertical as shown in FIG. 11, to detach the toner scraped from the belt, a cleaner 13 having an elastic blade shown in the figure may be employed. The other like parts in the figure are identified by like numerals which refer to like parts in FIG. 1. In this figure, the laser exposing unit 12 is arranged vertically in order to make effective use of space for aiming at small area.

The height of the charging unit 11 facing the surface of the photosensitive belt is approximately 20 mm, and the height of the photosensitive belt cleaner unit 13 including the erase lamp 325 facing the surface of the photosensitive belt is approximately 35 mm. When the intermediate transfer drum 2 is arranged in parallel to the center line of the roller 100 at the bottom side of the photosensitive belt 1, these units can be arranged beside the surface of the photosensitive belt on the side opposite to the side of the surface of the photosensitive belt on which the developing units 3 to 6 are arranged.

The laser exposing unit 12 in the embodiment of FIG. 1 will be described in detail below. The exposing position of the laser exposing unit 12 will be described. In the photosensitive belt formed of organic materials as described above, more than 150 ms is generally required for the time from starting of exposure to forming a stable electrostatic latent image. Therefore, the time from exposing to developing is set to 300 ms. If the position of exposure the photosensitive belt fluctuates, a blur takes place at the exposing point due to fluctuation in the focus, so as to degrade the resolution of the image. Thereby, exposure has to be performed at a position, such as a position on the roller 100 inside the photosensitive belt where the behavior of the photosensitive belt is stable. At the embodiment, the developing unit 3 placed in the nearest position to the exposing position is arranged at the position where the photosensitive belt departs from the roller 100. The photosensitive belt 1 wraps around the roller 100 over the range of 180 degrees. Since the diameter of the roller 100 is 23 mm, the length of the photosensitive belt 1 which contacts the roller 100 is approximately 36 mm. In order to perform exposure on the roller 100 in advance of developing by 300 ms, the process speed can be set to 120 mm/s (=36 mm/0.3 s) at a maximum. In this embodiment, the angle between the exposing position and the developing position is set to 150 degrees. In this case, the maximum allowable process speed is approximately 100 mm/s. In this embodiment, the process speed is set to 95 mm/s so as to provide for an allowance. As described above, the intermediate transfer drum 2 in the embodiment of FIG. 1 has a diameter of 92 mm, and then the peripheral length is approximately 289 mm. With a process speed of 95 mm/s, the intermediate transfer drum 2 rotates approximately 19.7 cycles per minute. In the embodiment of the apparatus shown in FIG. 1 where a sheet with a full-color image is printed with four rotations, a printing speed of approximately 5 pages per minute is possible. This is a main reason why the embodiment of the color image printing apparatus has a process speed of 5 pages per minute for full-color image printing (A4 size printing) and a process speed of 20 pages per minute for mono-color image printing. A higher printing speed may be possible in the embodiment shown in FIG. 1 by changing the size of the apparatus. The printing speed is, as described above, sufficient for a small-size full-color image printing apparatus of the desk-top type.

Figure 12:
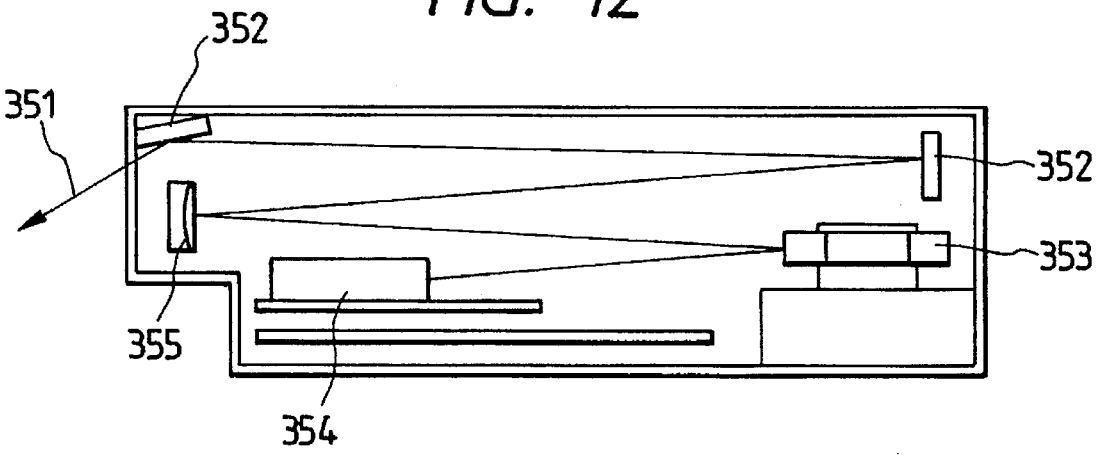
FIG. 12 is a view showing the details of the construction of an exposing unit.
Figure 13:
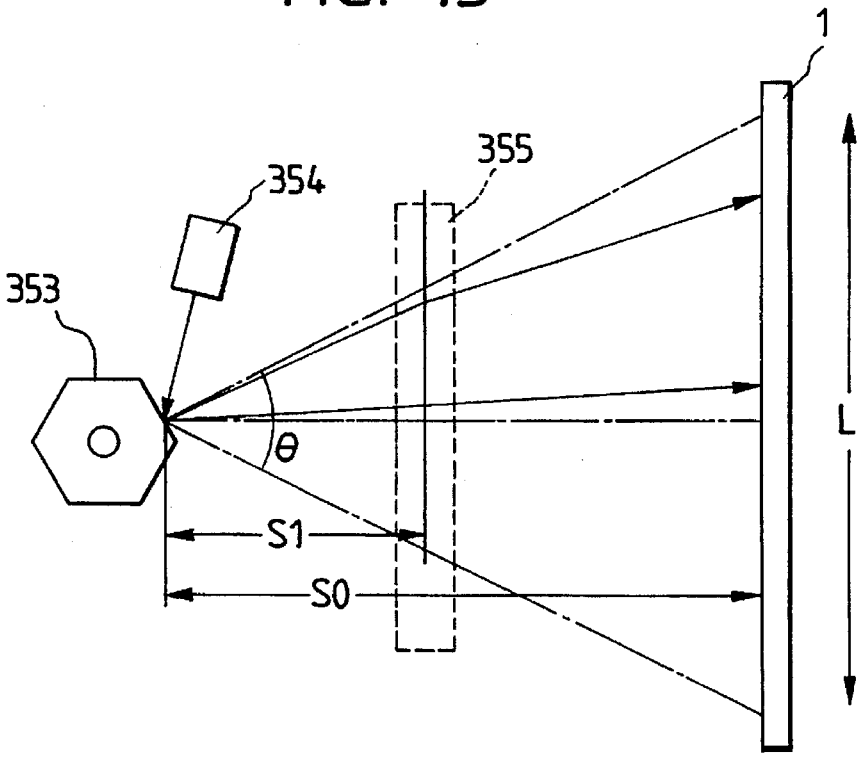
FIG. 13 is a view showing the construction of a light scanning portion in a laser exposing unit.

FIG. 12 shows the detailed construction of an embodiment of an exposing unit 12 in the embodiment in FIG. 1 according to the present invention. The exposing unit in the embodiment according to the present invention employ laser exposing apparatus 12 in order to perform a high resolution image printing. In FIG. 12, a laser beam 351 projected from a laser light source 345 is reflectively scanned with a polygon mirror 353, the light passes through an fθ lens 355 of the reflection type, is reflected by two reflecting mirrors 352, so as to be directed toward the surface of the photosensitive belt, which is not shown in this figure. FIG. 13 is a view showing the construction of a scanning part in the laser exposing unit. A laser light beam 354 from a semiconductor is reflectively scanned with a polygon mirror 353, and the difference in the focal length due to the difference in light path up to the surface of the photosensitive belt 1 of the object to be exposed and the fluctuation in the displacing distance on the scanning surface per unit of rotating angle of the polygon mirror 353 are corrected with an fθ lens 355 of the transparent type. In order to obtain the width of the printing image for the laser scanning width, it is necessary to keep a long light path length from the polygon mirror to the photosensitive belt. When the scanning angle of the polygon mirror is small, the amount of correction with the fθ lens becomes small and it is easy to obtain a stable quantity of exposing light in the scanning direction. However, when the scanning angle is small, the length from the polygon mirror to the photosensitive body becomes long and the whole size of the optical system becomes large. Therefore, the limitation of the scanning angle is nearly 100 degrees (50 degrees in one side). In a case of setting the scanning angle to 100 degrees, in order to scan about 300 mm of side length of an A4 size paper in the longitudinal direction, the required length from the polygon mirror to the photosensitive body is obtained from the following equation.

$$S_0 = \lim_{X_0 \to 0} \left( \frac{X_0}{\tan(\theta/L \cdot X_0)} \right) \tag{1}$$

In equation (1) $S_0$ is the required light path length, L is the scanning length, θ is the scanning angle, and $X_0$ is the distance from the center point of scanning. By inserting the above values into the equation and approaching $X_0$ to O, $S_0$ becomes approximately 172 mm. In order to make the width of the fθ lens smaller than the width of the scanning surface of 300 mm under this condition, it is necessary to set the distance from the polygon mirror to the fθ lens to be less than the distance obtained from the following equation.

$$S_1 = \frac{1}{2} \cdot \frac{1}{\tan(\theta/2)} \tag{2}$$

By inserting a scanning distance L=300 mm and a scanning angle θ=100 degrees, $S_1$ becomes approximately 126 mm. Therefore, in this construction, it is necessary to place the fθ lens 355 at a position nearer than approximately 126 mm to the polygon mirror 353. As for the optical system unit used in the embodiment in FIG. 1 according to the present invention, if the height of the optical system unit is larger than approximately 100 mm, the entire apparatus becomes large since the diameter of the intermediate transfer drum 2 is 92 mm. However, compared to the allowable height of the optical system unit, the length of laser light path required in the laser exposing unit 12 obtained from the calculated result is considerably long.

Figure 14:
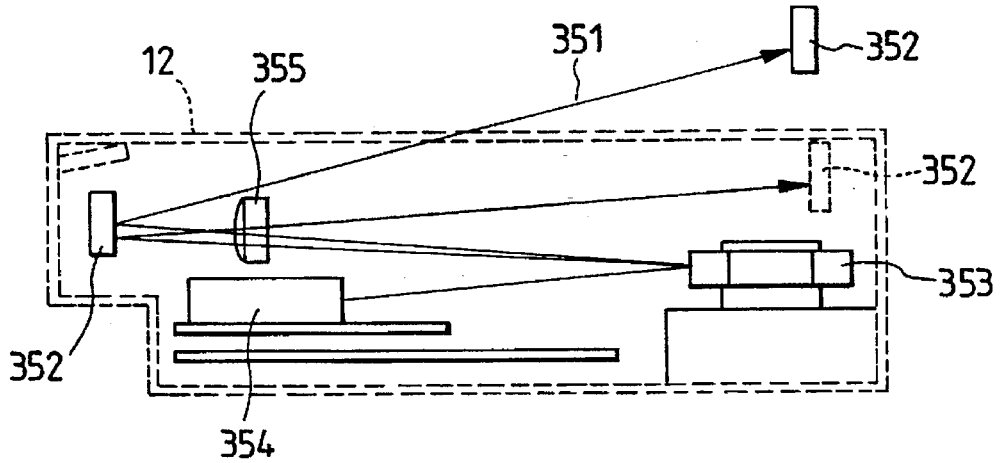
FIG. 14 is a view showing the construction of an exposing portion when an fθ lens is used.

Therefore, in the embodiment shown in FIG. 12, the light path after scanning is folded two times in the longitudinal direction of the laser exposing unit 12 using reflecting mirrors 352. In a construction where an fθ lens is inserted between the reflecting mirrors, as shown in FIG. 14, it is necessary to ensure that the reflected light after passing through the fθ lens does not pass through the fθ lens again. Thereby, since the reflecting angle of the first reflection is set to be large, the size of the laser unit in the thickness direction is increased. Therefore, in the construction of the embodiment shown in FIG. 12, the reflecting mirror for the first reflection is formed in a shape having the fθ characteristic. In this construction, since the reflecting angle from the reflecting mirror for the first reflection can be made small, the optical length can be kept long without increasing the size of the optical system unit in the thickness direction. The fθ mirror of such type can be easily fabricated by vapor-depositing aluminum or the like on a plastic molded member, and it is comparatively easy to fabricate mirrors of any shape (a free curved surface not limited to spherical, aspherical, symmetric, asymmetric) having various characteristics.

Figure 15:
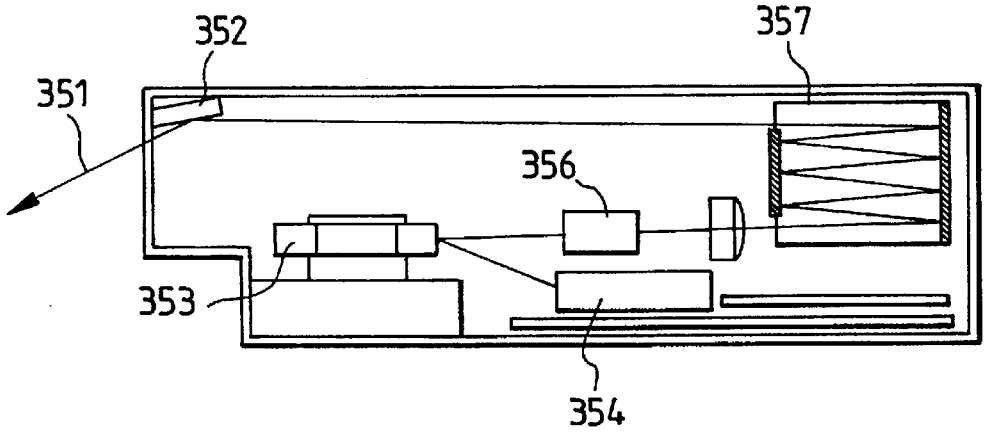
FIG. 15 is a view showing the construction of another form of the exposing unit.

FIG. 15 shows another construction of the optical system. Behind the polygon mirror 353 there is a multi-reflection mirror 357 having mirrors placed in parallel to each other to reflect a laser beam turning back and forth inside the multi-folding mirror. The multi-reflection mirror is fabricated by vapor-depositing aluminum or the like on the surfaces of a plastic block or a glass block to form mirrors. Since a laser beam is turned back and forth plural times inside the multi-reflection mirror, a long light path can be obtained. In such a multi-reflection system, the incident angle to the mirror is different between the central portion of an image and the edge portions of the image, which causes a difference in attenuation of the laser beam. In order to cope with this phenomenon, there is provided in the embodiment of FIG. 15 a polarization control means 356 for polarizing the laser beam before it enters the multi-reflection system. The difference in the attenuation after passing through the multi-reflection mirror 357 can be corrected by the polarizing direction of the laser beam. There can be considered another method where the intensity of light generated by the laser light source 354 is controlled in synchronism with the rotation of the polygon mirror 353 to correct the amount of attenuation of the laser beam 351 corresponding to the exposing position on the photosensitive body.

By employing the above means, the laser exposing unit 12 in the embodiment according to the present invention shown in FIG. 1 becomes approximately 100 mm wide and approximately 30 mm high. As for other methods to make the optical system small, it is possible to use an optical system made up of a LED array or liquid crystal shutter. However, the laser exposing type is superior to others in definition and stability of exposing light intensity at the present time.

As for the developing units 3 to 6, the developing units are aligned in a line along the straight portion of the photosensitive belt as described above. These developing units have to perform a contact operation and a stand-by operation one-by-one corresponding with each rotation of the photosensitive belt when a color image is formed. Further, in order to realize a stable high image quality developing in a two-component developing method, a high accuracy in the order of 100 μm is required in the gap between the developing roll and the developing unit during developing. In the construction of the embodiment, the four developing units and the photosensitive belt are incorporated in a unit in order to maintain a high accuracy in the gap between the photosensitive belt and the developing units. Furthermore, in the embodiment, the toner cassettes are formed in separate units from the developing-unit/photosensitive belt unit in order to make toner supply easy by independent supply of toner.

Figure 16:
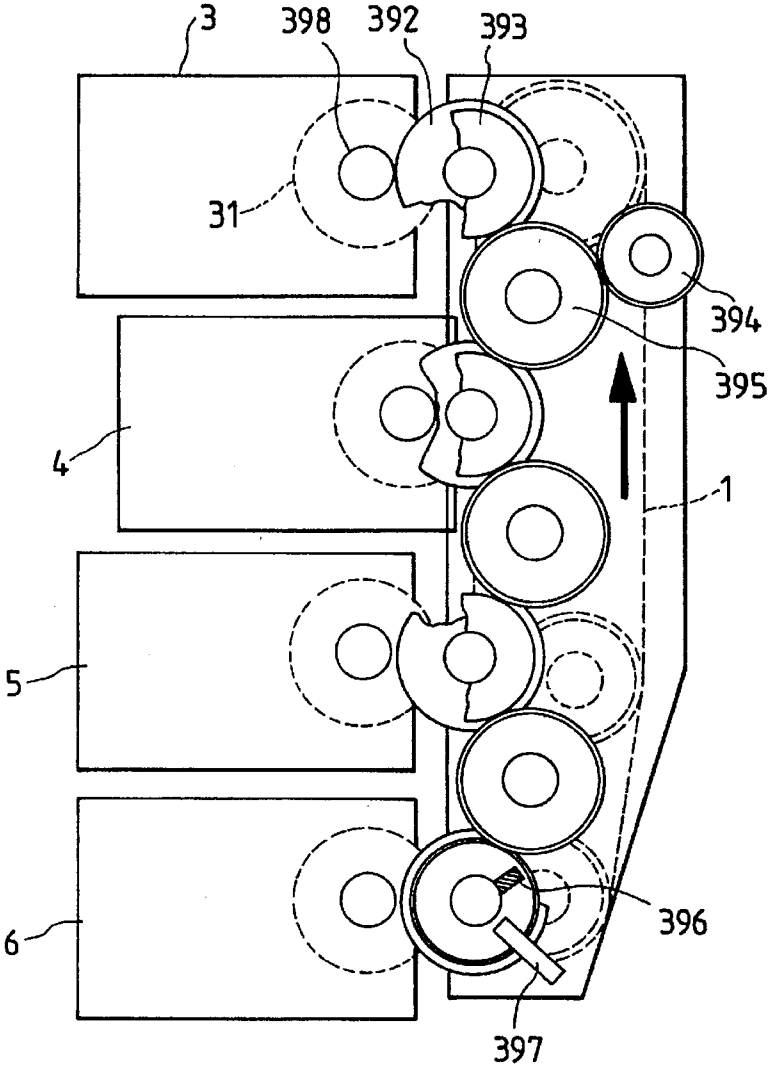
FIG. 16 is a view showing the details of the constructions of a developing unit and an photosensitive body unit.

FIG. 16 shows the details of a developing unit standby-contact mechanism in the developing-unit/photosensitive belt unit in the embodiment. The developing unit 3 has a developing roller 31 in a developing roller shaft 398, and a cam mechanism having cams with a notch in a part of the periphery is provided in the side of the photosensitive belt 1. The four cams 329 are linked with gears 393, 395 so that the four developing units are moved into contact with the photosensitive belt one-by-one by rotating the gears in the edge region through a given angle step-by-step using a driving mechanism in the image forming apparatus through a driving source connecting gear 394 when the developing units are mounted in the image forming apparatus. In FIG. 16, the gears placed on the cams are partially cut away to show the cams. The positional states of the developing units are basically four positional states where one of the developing units for four colors contact the photosensitive belt and one positional state where all the developing units are in a stand-by state separated from the photosensitive belt. During off-printing, the cam mechanism is set so that all the developing units are in a stand-by state. And, during printing, the cam mechanism is controlled in such that each of the developing units sequentially contacts the photosensitive belt one-by-one. A mark 396 is attached to a part of a linked gear in the developing-unit/photosensitive-belt unit to control the contact and stand-by states of each of the developing units, using a developing-unit-stand-by mechanism controller (not shown) in the main body of the image forming apparatus, by identifying which developing unit contacts the photosensitive belt through detection of the position of the mark using a sensor (photosensor or the like) 397 placed on the main body of the image forming apparatus.

Figure 17:
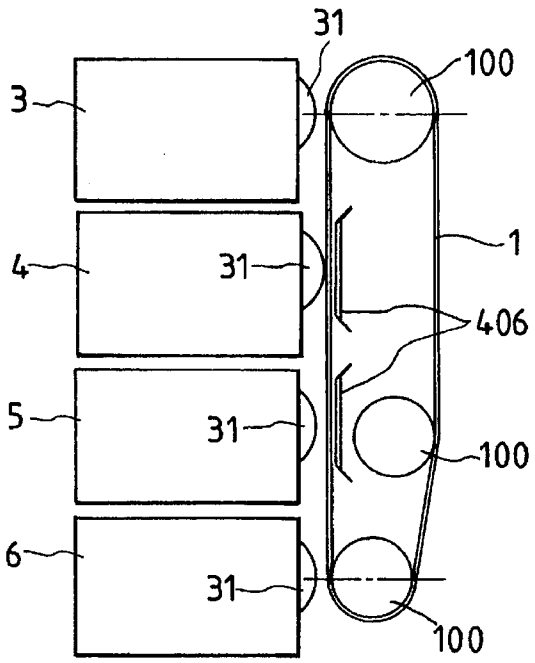
FIG. 17 is a view showing the construction of a photosensitive body guide applied to a two-component developing apparatus.

In a two-component developing unit, the gap accuracy during printing is very important. In the construction of FIG. 17, since two developing units at the ends among four are in the positions facing the surface of the photosensitive belt at the position of the inner rollers 100, the behavior of the photosensitive belt at these positions is stable and the gaps are easily kept constant. However, the other two developing units are placed along the straight portion of the belt, and so it is required to arrange guide members 406 in contact with the belt as shown in FIG. 17. Although the guide members 406 in the figure are flat-shaped, it is possible to use rotating rollers 413 as shown in FIG. 18 as the guide members.

Description will be made below concerning the contact and stand-by operations in a case of using a non-magnetic one-component developing unit as the developing unit. In the non-magnetic one-component development, there is no need to keep a certain accuracy as in two-component development. However, since the development is performed by contacting a toner layer having thickness of several tens of μm formed on the developing roll 31 to the photosensitive belt, the developing roll 31 and the photosensitive belt 1 have to be stably and perfectly in contact with each other. It is ideal when the photosensitive belt 1 and the developing roll 31 are in a contact state having a nip width. Therefore, some troubles will result due to the contact positions and the guide construction for the two-component developing unit shown in FIG. 17.

Figure 18:
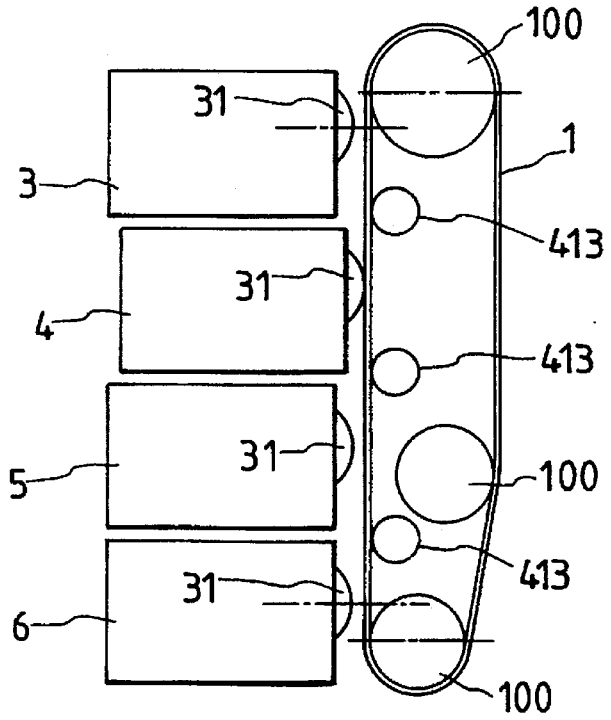
FIG. 18 is a view explaining the construction of a photosensitive body guide applied to a one-component developing apparatus.

FIG. 18 shows contact positions of the developing units and the construction of guide members for the photosensitive belt 1 when one-component developing units are used. The photosensitive belt 1 needs to contact a developing roll 31 of the, developing unit under performing development with a nip contact. Therefore, the contact positions of the developing rolls 31 of the developing units at both ends are required to be positioned in the middle side from the inner rollers 100 inside the photosensitive belt. With this arrangement, the photosensitive belt 1 deflects along the developing roll 31 of the developing unit contacting the photosensitive belt to easily keep a stable nip. As for the two developing units in the middle portion, a sufficient nip can be given by displacing two guide rollers 413 toward the developing units.

As for another method, in a case of using the guide member 406 shown in FIG. 17, it is possible to form the guide member 406 in a concave shape or to place an elastic material on the surface. Further, it is possible to form the developing roll itself with an elastic material to stably contact the photosensitive belt with the deformation of the developing roll 31. However, the developing roll 31 is preferably made of a rigid material, such as a metallic material, taking the life of the developing roll 31 into consideration in the one-component developing unit, which has many blade friction members.

In one-component development, as described above, since the developing units cannot be placed just on the inner rollers 100 inside the photosensitive belt 1 at both ends, the allowable height per one developing unit becomes a little small compared to in a two-component developing unit. However, since the one-component developing unit does not require any mixing chamber and any magnet roller, the height generally does not become a large problem for decreasing its size compared to the two-component developing unit.

The intermediate transfer drum 2 has a semiconductor layer or an insulator layer on the surface of a metallic roller. The surface is covered with an elastic material having a thickness of several hundreds μm to several mm so as not to scratch the surface of the photosensitive belt during contact with the photosensitive belt 1. In the color image forming apparatus in FIG. 1, the intermediate transfer drum 2 is grounded, and, on the other hand, the base voltage of the photosensitive belt 1 is approximately 500 V negative to electrostatically transfer an image of each color charged negative formed on the photosensitive belt 1. Further, a composite image of respective color images formed on the intermediate transfer drum 2 is transferred to a paper using the transfer roller 17 arranged under the intermediate transfer drum 2. The image transferring to a paper is electrostatically performed by applying a positive voltage to the transfer roller 17.

In order to prevent the intermediate transfer drum 2 from being charged by the processing units arranged around the intermediate transfer drum 2, it is preferable that the surface insulator layer has a resistance smaller than a certain value. In the color image forming apparatus shown in FIG. 1, the process speed is set to 95 mm/s. Let the capacitance of the layer of the intermediate transfer drum be C ($F/cm^2$) and its resistance be R ($\Omega/cm^2$). The time required for the charge on the surface of the intermediate transfer drum to dissipate is approximately C×R seconds. If the value is less than 100 ms, the charge on the surface of the intermediate transfer drum is dissipated while the intermediate transfer drum 2 moves approximately 1 cm. However, when the intermediate transfer drum is conductive, as discharge takes place at the time of contact with the photosensitive belt or in the contact position with the transfer roller 17. Therewith, a fault occurs in a printing image. For the reason described above, it is necessary to form the surface layer of the intermediate transfer drum 2 with a semiconductor material. In a case where a discharge mechanism for a control charge on the surface of the intermediate transfer drum 2 is arranged around the intermediate transfer drum 2, it is possible that the resistance of the surface layer of the intermediate transfer drum 2 may be an insulator having a very high resistivity. As the discharge mechanism to control the charge, there can be used a discharging mechanism having non-contact needle-shaped members, an AC corona discharger or a scorotron charger.

In the embodiment of the color image forming apparatus according to the present invention as shown in FIG. 1, the mechanism for transfer of a color image formed on the intermediate transfer drum 2 to paper employs a roller transfer method. The toner image composed of respective color images on the intermediate transfer drum 2 is different in its thickness depending on the positions of the image. In order to transfer the image completely and certainly, it is important that the intermediate transfer drum 2 is certainly and intimately in contact with the paper forming the image receiving body. Therefore, a roller transfer method is employed in this embodiment. In a case where a paper is certainly and intimately in contact with the intermediate transfer drum 2 using a paper guide or the like, a corona transfer method may be employed.

Figure 19:
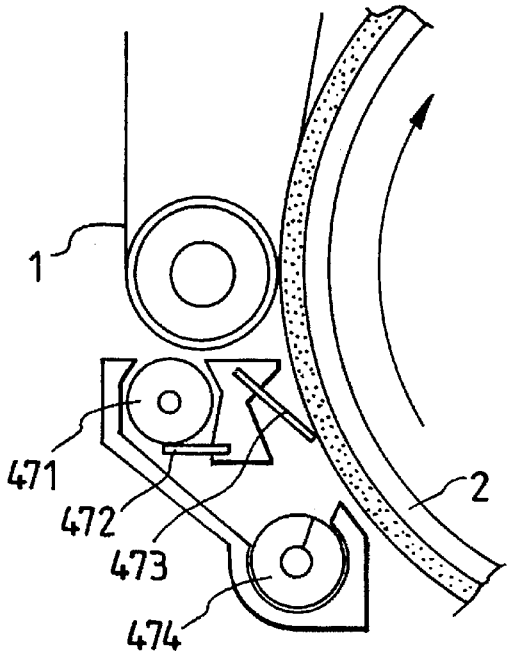
FIG. 19 is a view showing another form of an intermediate transfer body cleaner in accordance with the present invention.

In the embodiment of the color image forming apparatus according to the present invention as shown in FIG. 1, a blade cleaning method is employed in the cleaner for the intermediate transfer drum 2. FIG. 19 shows another cleaner for the intermediate transfer drum 19 which may be used in the color image forming apparatus of FIG. 1. In the construction of this embodiment, a blade cleaning method using a blade cleaner 473 having a simple construction is employed, since the position of the cleaner is under the side of the intermediate transfer drum 2. However, as described in connection with the photosensitive belt cleaner 13, if a cleaner is positioned at such a position that the toner cleaned off falls toward the surface of the intermediate transfer drum 2, it is preferable to employ a brush cleaning method, such as the method performed in the photosensitive belt cleaner 13 described above. The cleaner in FIG. 19 has such a construction that the carrier which falls off from the developing roll is collected by arranging a magnet roll 471 and a scraping blade 472 in a upper position within the unit. In the embodiment of the color image forming apparatus according to the present invention as shown in FIG. 1, the disposed toner and the disposed carrier transported from the photosensitive belt cleaner 13 and the intermediate transfer drum cleaner 13 are transported to the toner box 14 in FIG. 1 through transporting means 474 having a rotating spiral in a pipe.

Since the paper which has received an image has a remaining charge due to transfer in the reverse surface, the paper sticks to the intermediate transfer drum 2 and, in some cases, cannot be peeled off by gravity alone, and, while the paper, after being peeled off passes through the transporting path to the fixing unit, a discharge takes place with the parts in the area around the paper so as to disturb the image. In this embodiment, the discharger is provided to easily peel off the paper from the intermediate transfer drum 2 and to prevent the occurrence of discharge on the transporting path to the fixing unit. Although a discharging mechanism utilizing an AC corona discharge is used in the embodiment of FIG. 1 according to the present invention, it is possible to employ a method where a conductive brush is caused to contact the reverse surface of the paper.

Figure 20:
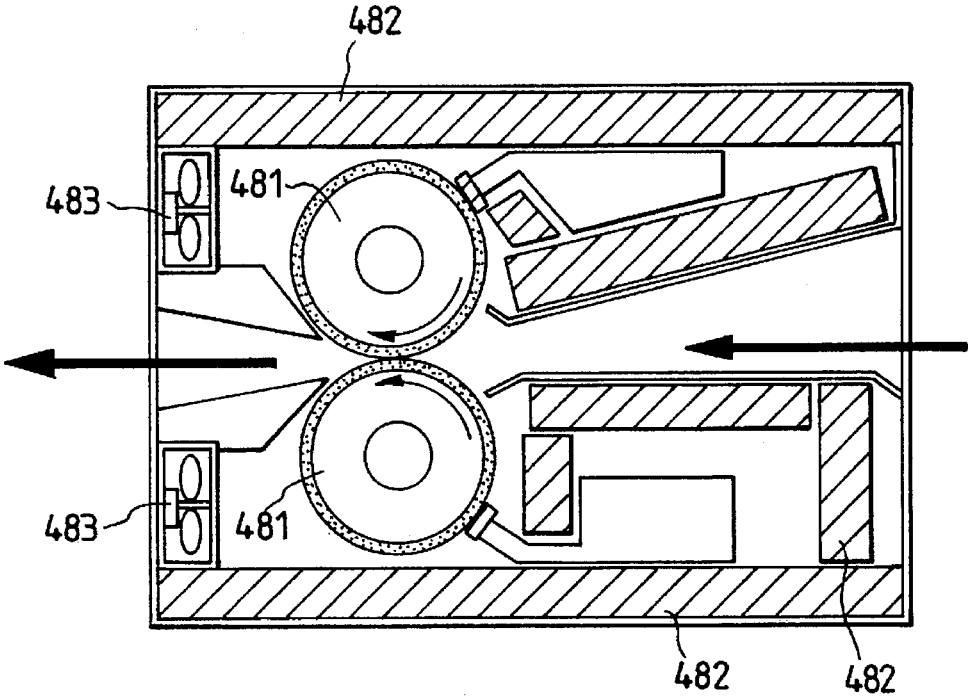
FIG. 20 is a view showing the details of the construction of a fixing unit.

In the embodiment of the color image forming apparatus according to the present invention shown in FIG. 1, a roller fixing unit 20 shown in FIG. 20 is employed. The process speed in the embodiment is 95 mm/s as described above. The outer shape and the fixing temperature of the fixing rollers 481 are generally determined by the supplied heat, the distance of the nip portion nipping the paper and the pressure. Using the construction of a conventional fixing unit used in a printer utilizing electro-photographic method, for the fixing roller 481 of a fixing unit applicable to the process speed in the embodiment, it is proper that the fixing temperature is 100° to 200° C. and the diameter of the fixing roller is around 30 mm. However, these setting values largely depend on the characteristics of the toner material used. The roller 481 of the fixing unit in the embodiment of the color image forming apparatus according to the present invention as shown in FIG. 1 has a diameter of approximately 30 mm, and this size is small enough to be employed under this construction of the apparatus.

If the heat inside the fixing unit is conducted to the toner containing chamber unit of the developing unit and the like, the toner in the developing unit or in the toner containing chamber is melted and freezed to cause a problem.

Therefore, it is necessary to provide a thermal insulating member 482, such as a foamed resin plate, between the fixing unit and the developing unit and the toner containing chamber. Further, it is necessary to provide a heat exhausting mechanism having a heat exhausting fan 483 for exhausting heat in the paper output direction. In the embodiment according to the present invention shown in FIG. 1, the unit is constructed in such a way that the top side and the bottom side are surrounded with thermal insulating members 482 and heat exhausting fans are provided to blow out the heat in the paper output direction.

Figure 21:
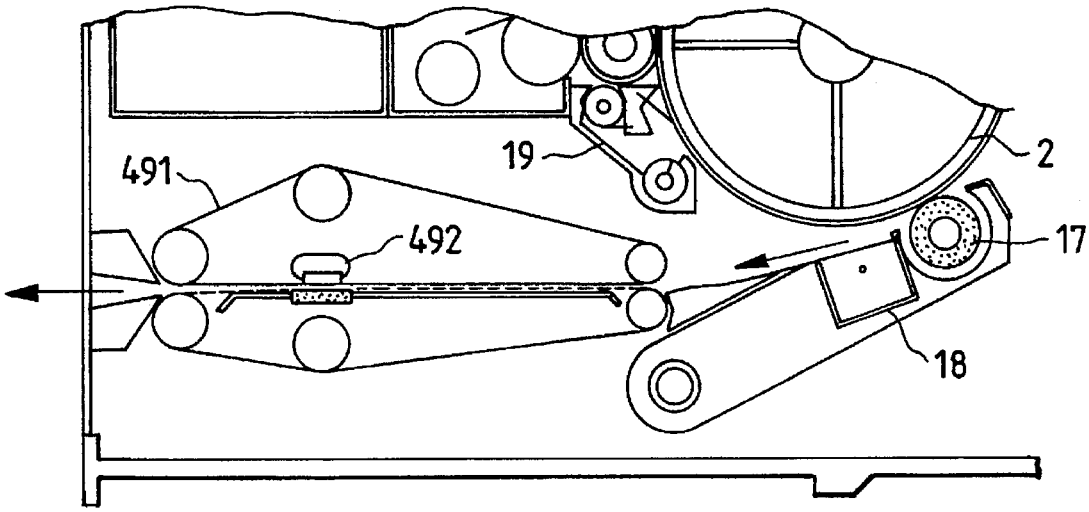
FIG. 21 is a view showing another form of a fixing unit.

As for another method in connection with the fixing unit, it is effective to employ a method using a heater fixed to the fixing position and a belt-shaped transporting member. FIG. 21 shows an embodiment employing a fixing method using a belt-shaped transporting member 491 and a fixed heater 492 applied to the embodiment according to the present invention shown in FIG. 1. In this method, the amount of heat generated in the fixing unit can be deceased, and the position of the heat source of the fixing unit can be freely set since the heat is transported by the belt. By arranging the entrance for the belt of the fixing unit near the transferring and peeling position of the paper, it is possible to print an image on a small sized paper since the distance for transporting paper from the transfer roller 17 to the fixing unit 20 can be short.

Figure 22:
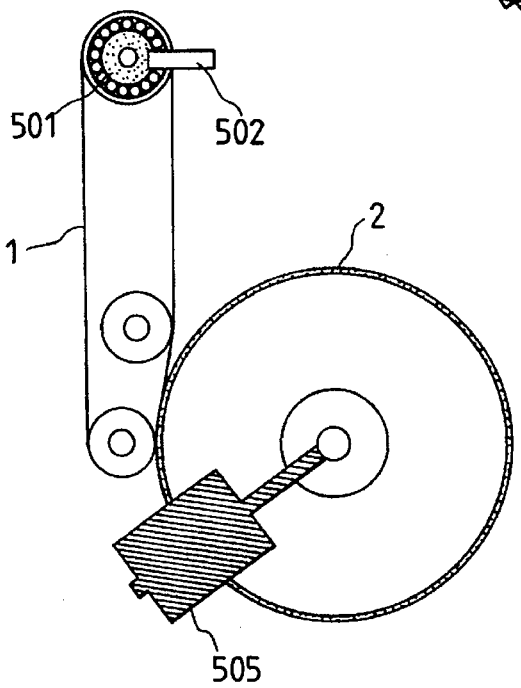
FIG. 22 is a view showing the construction of a driving system.
Figure 23:
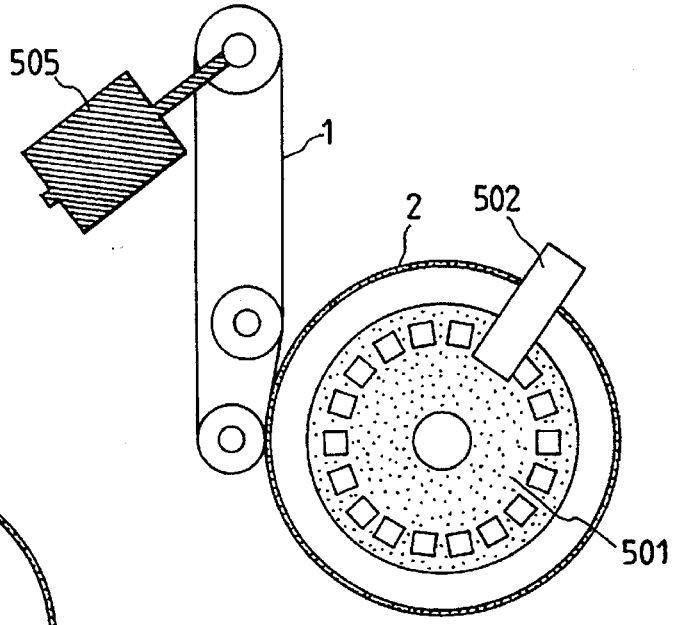
FIG. 23 is a view showing the construction of another form of a driving system.

The driving mechanism for the photosensitive belt 1 and the intermediate transfer drum 2 shown in FIG. 1 will be described below. In order to accurately superpose images of respective colors, it is necessary to drive the photosensitive belt 1 and the intermediate transfer drum 2 in perfect synchronization. As the driving method, it is possible to use two pulse motors and to control rotations of the both members with a high accuracy. However, in order to perform such control, an extremely highly accurate motor control and very high accuracies of dimensions in the diameter of the intermediate transfer drum and various parts of the photosensitive belt are required. Therefore, this embodiment employs a driving method where a driving motor 505 is connected to the intermediate transfer drum 2 and the photosensitive belt 1 is driven by the intermediate transfer drum as shown in FIG. 22. The rotating speed is controlled to be constant by detecting the rotating speed with a rotating speed detecting disk 501 provided in the center of the roller for the photosensitive belt 1 and a rotating speed detecting sensor 502 for the rotating speed detecting disk. Another embodiment is shown in FIG. 23 where the roller inside the photosensitive belt 1 is driven by the motor, the rotating speed detecting disk 501 and the rotating speed detecting sensor 502 are provided in the intermediate transfer drum 2, and the photosensitive belt 1 and the intermediate transfer drum 2 are driven by the roller inside the photosensitive belt.

Figure 24:
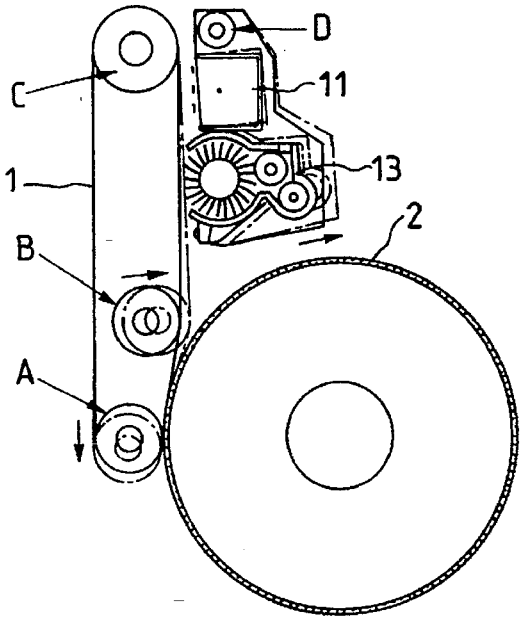
FIG. 24 is a view showing the direction of a tensile force applied to the photosensitive body unit in the apparatus in FIG. 1 and a member for applying that tensile force.

The mechanism to Give tensile force to the photosensitive belt 1 will be described below. In order to absorb the increase in the length of the belt due to long use or the deflection of the belt when it contacts the intermediate transfer drum 2, it is necessary to provide a mechanism to adjust its tensile force. FIG. 24 shows the direction of a tensile force Given to the photosensitive belt unit in the color image forming apparatus according to the present invention shown in FIG. 1 and a member to give the tensile force. The extension of the belt is absorbed mainly by the roller A and the deflection of the belt during contact with the intermediate transfer drum is absorbed by the rollers A and B. In this construction, the tilting angle of the belt between the roller B and the roller C is changed a little due to the displacement of the position of the roller B toward the side of the intermediate transfer drum. Therefore, in this embodiment, the charging unit 11 and the photosensitive belt cleaner unit 13 are constructed so as to be displaceable as a unit in the direction indicated by an arrow in the figure. Among the rollers inside the photosensitive belt in an apparatus having a tensile force adding mechanism for the photosensitive belt 1, the inner roller C used as a guide in the laser beam exposing position inside the photosensitive belt is not provided with the tensile force adding mechanism in this embodiment.

Figure 25:
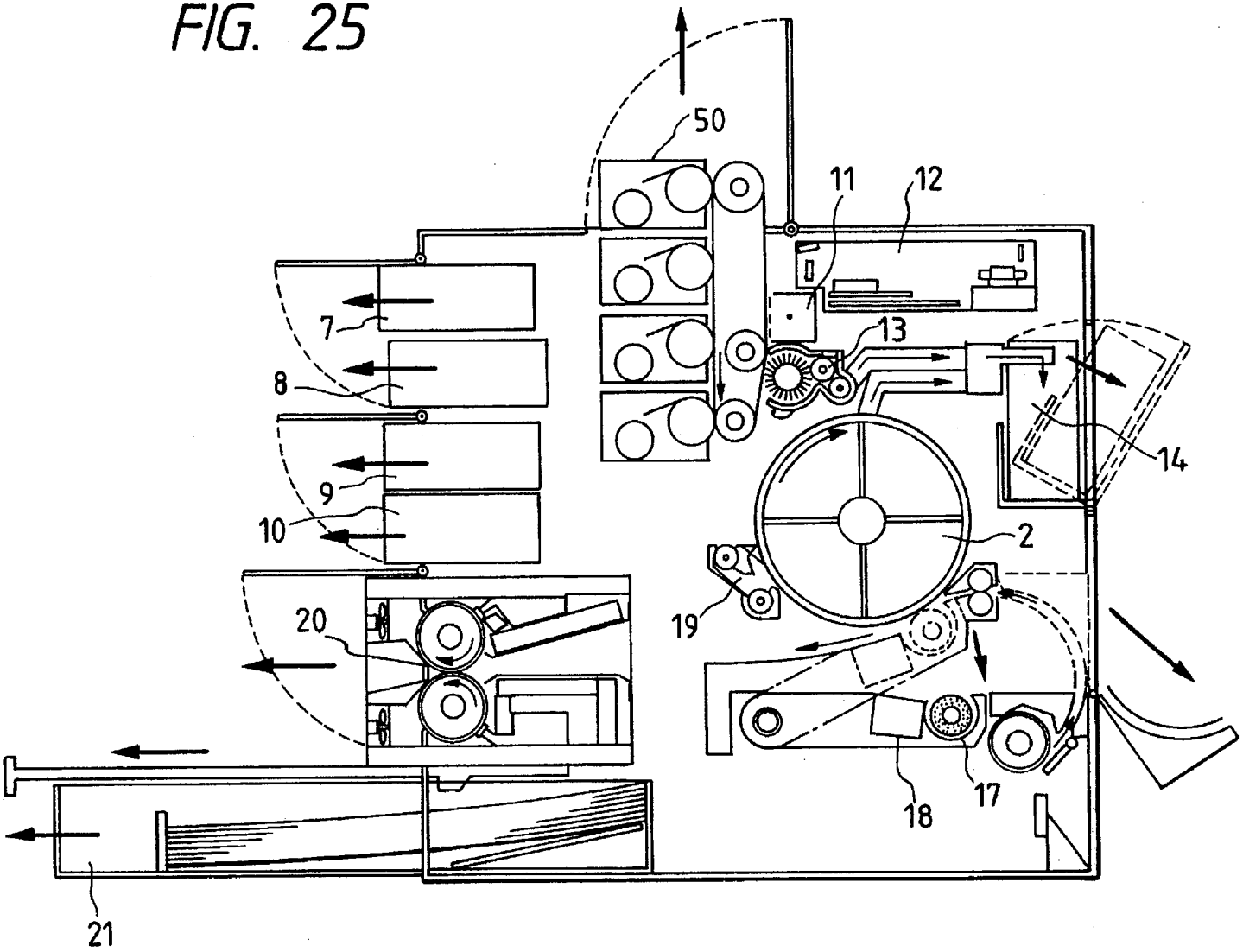
FIG. 25 is a view showing the dismounting of individual parts and the inserting directions of parts in the apparatus shown in FIG. 1.

FIG. 25 shows the dismounting of individual parts and the inserting directions of parts in the color image forming apparatus according to the present invention as shown in FIG. 1. The embodiment of the color image forming apparatus according to the present invention has a construction which calls for it to be operated from the left hand side in the figure which is the front side. The paper tray 21 is inserted from the front of the apparatus as shown in the figure. A paper is inserted from the front side and turned back to be transported to the transfer roller 17 arranged diagonally under the intermediate transfer drum 2. The paper after receiving an image is peeled off in the direction of the gravity and then put out above paper cassette 21 through the fixing unit 20 arranged under the developing units 3 to 6. As shown in the figure, the cover of the paper cassette 21 has a slidable structure and may be used as a paper tray for output papers.

The toner containing chamber units 7 to 10 are inserted also from the operating face in the left hand side of the figure, and the photosensitive-belt-and-developing unit 50 is inserted from the top. On the back surface there is a door for the disposed toner box 14 which moves together with the door upon opening the door as shown in FIG. 25 to mount and dismount easily from the upper side.

In the lower portion of the back surface there is also a door for access in curing jamming. The transfer unit has construction so as to be movable downward to remove a jammed paper when a paper is jammed. However, when a paper of A4 size is jammed, the jammed paper may be removed, in most cases, through the exit of the paper cassette 21 or the fixing unit, since the apparatus is small sized. Otherwise, since the fixing unit 20 is formed in a unit structure and can be drawn from the front as described above, the jammed paper may be removed by taking off the fixing unit.

Figure 26:
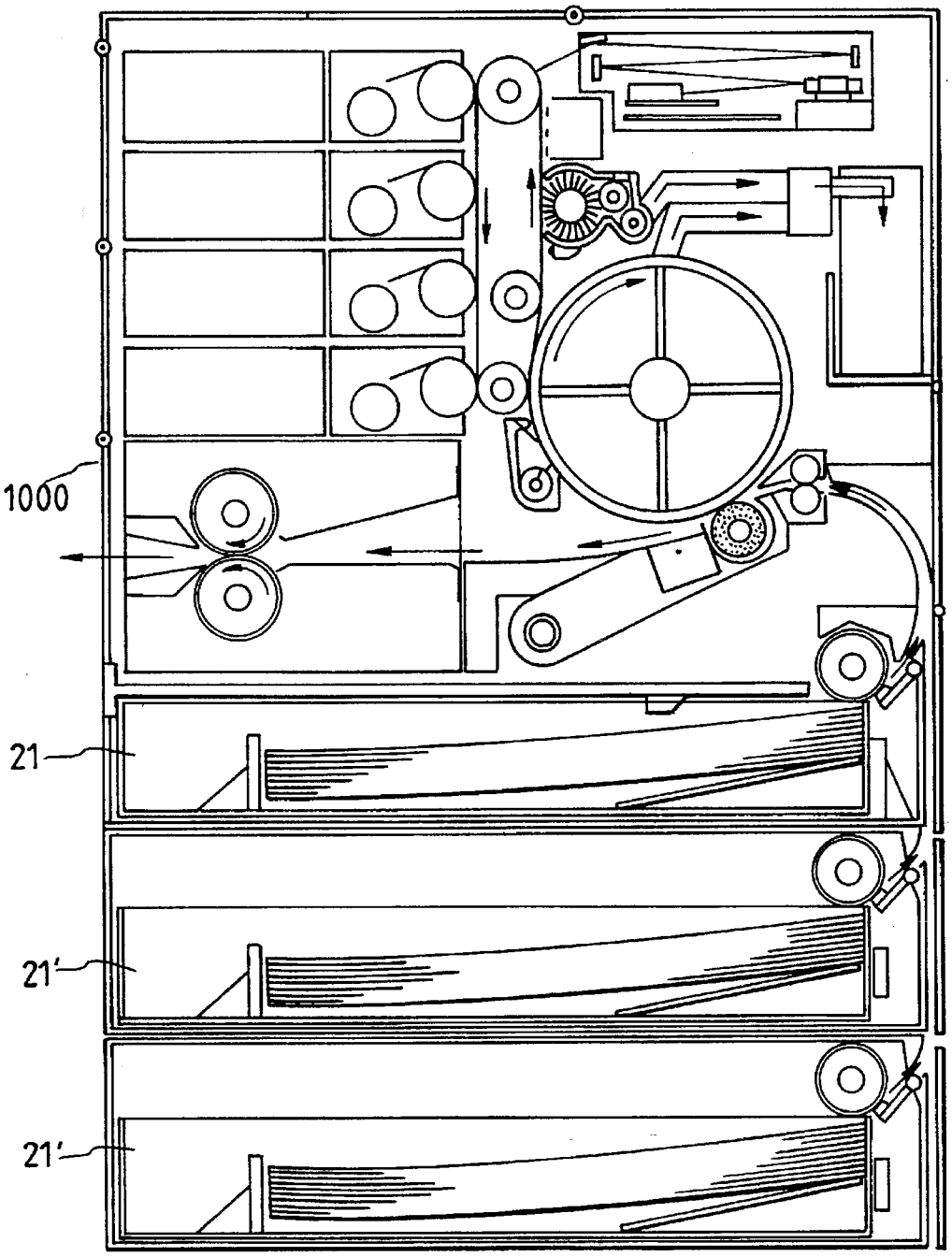
FIG. 26 is a view showing an embodiment including paper cassettes.

In a construction where a paper cassette is arranged in a lower position, it is possible to easily add other additional paper cassettes 21' under the main paper cassette 21 as shown in FIG. 26.

Although the embodiment of the color image forming apparatus according to the present invention shown in FIG. 1, as described above, is designed for printing on A4 size paper, it is clear that a color image forming apparatus capable of printing on A3 size paper is possible by increasing the dimensions of its parts a little. However, in a high-image-quality color image forming apparatus having resolution of more than 400 dpi according to the present invention, it is possible without degradation in image quality to scale the A3 image down to an A4 down-sized print through software processing. Printing on large size paper consumes a lot of toner in printing, and requires much more toner especially in a color image print often having a high printing area ratio. Further, the amount of image information for printing becomes more than nearly 100 M Bytes, as described above. In considering these facts, in a small-size color image forming apparatus capable of being easily used on a desk-top according to the present invention, a printing apparatus for A4 size paper is thought to be proper. In this sense, the embodiment according to the present invention has been described based on the size and dimensions of apparatuses for A4 size paper printing.

Figure 27:
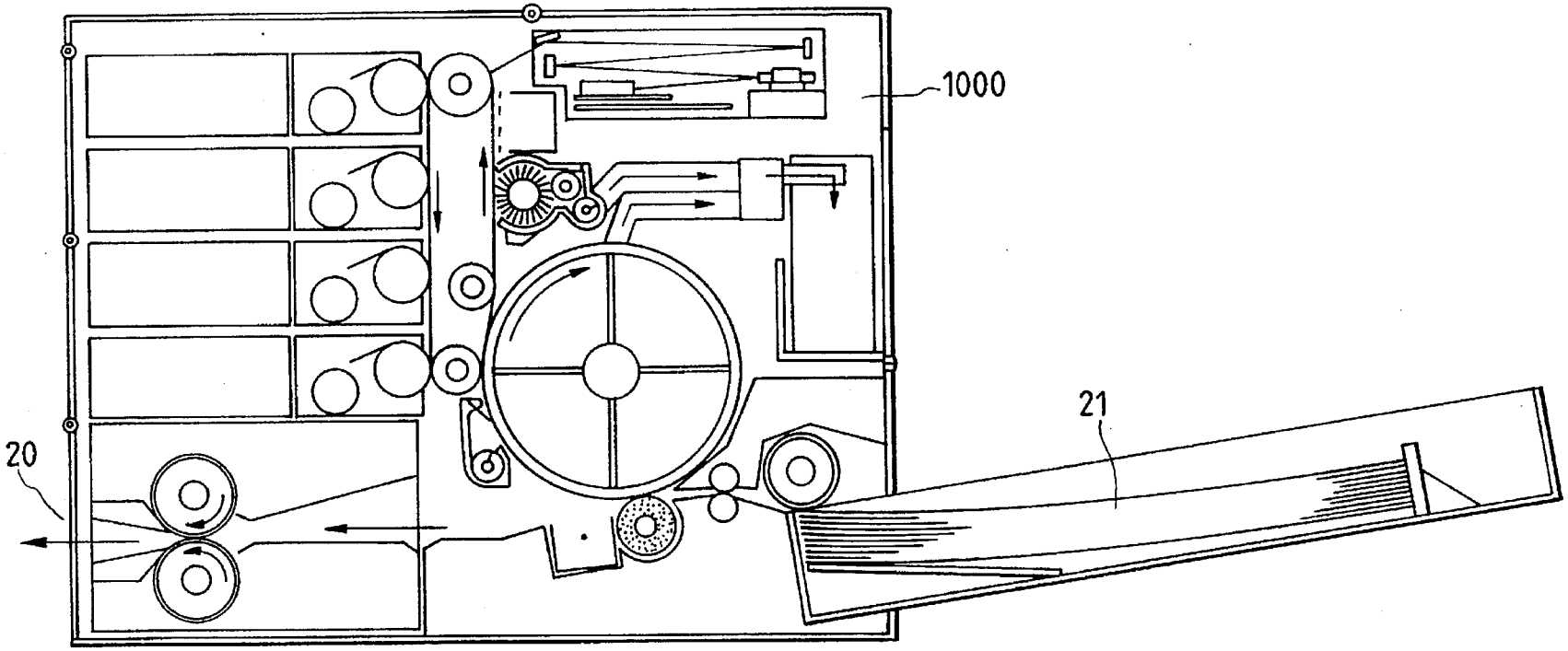
FIG. 27 is a view showing another form of paper transportation.

FIG. 27 is a view explaining another arrangement for paper transportation according to the present invention. A paper cassette 21 is inserted from the right hand side in the figure, and paper is transported in the horizontal direction and discharged on the right hand side. Since the paper cassette 21 is not placed in the bottom portion in this construction, the height of the entire apparatus can be lowered. In the embodiment in FIG. 27, the height of the main body of the printing apparatus is approximately 230 mm. However, since the color image forming apparatus needs to be operated from both the left hand side and the right hand side, there is a disadvantage in that the apparatus requires more room for installation in comparison to the construction of the embodiment in FIG. 1.

Figure 28:
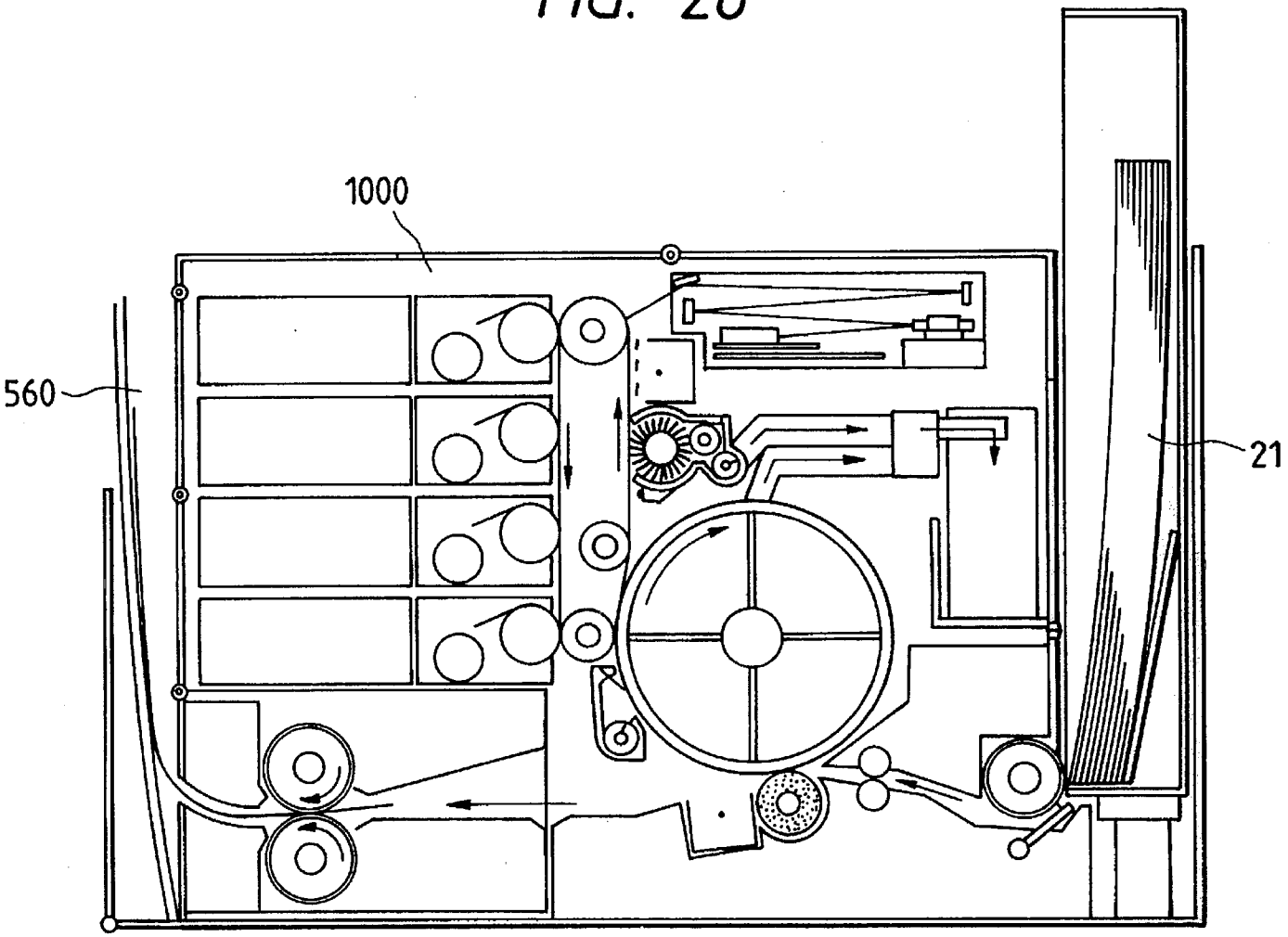
FIG. 28 is a view showing another form of paper transportation.

FIG. 28 is a view showing another arrangement for paper transportation according to the present invention. The paper cassette 21 is inserted from the top side of the main body of the printing apparatus 1000 so as to be vertically placed. The printed paper is vertically discharged to a vertical paper discharging tray 560. In this construction, the upper portion of the paper tray can be folded when the toner containing chamber units are inserted. With this construction, it is possible to realize an apparatus height nearly equal to the height of the embodiment of FIG. 27 and a comparatively small installing space. However, since the direction of drawing a paper from the paper tray is in the direction of gravity, it is necessary that the shape of a separating pad for picking a paper from sheet of pick roller is formed with high accuracy and to set the pushing pressure of the pick pad stably.

Figure 29:
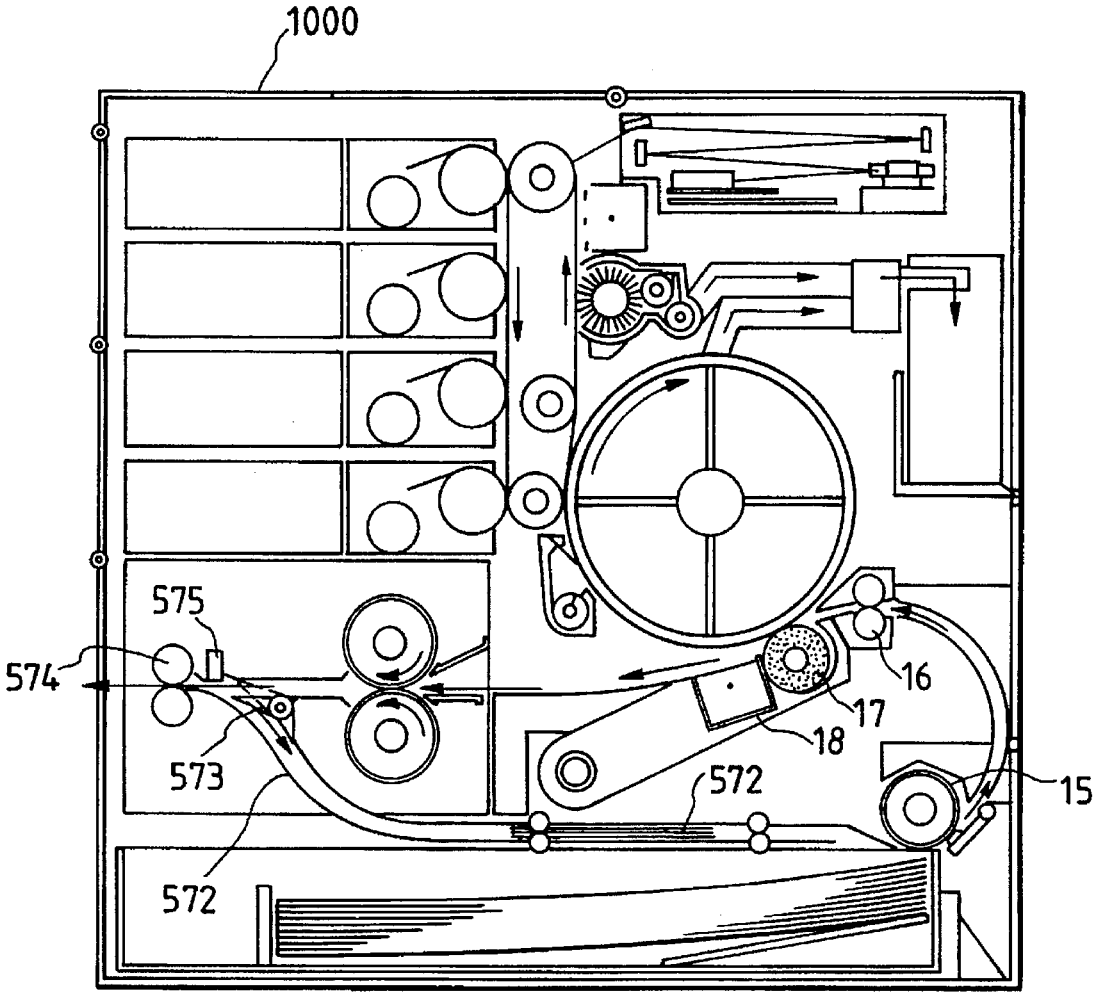
FIG. 29 is a view showing another form of paper transportation.

FIG. 29 is a view showing another arrangement for paper transportation according to the present invention. In this apparatus, a sheet of paper having an image which has been fixed is put between auxiliary rollers 574, passes through a return transporting path 572 provided on the top surface of the paper cassette with the aid of a transporting direction switching tab 573 by detecting the edge of the paper using a paper edge detecting sensor 575, and then is printed after passing through a pick-up roller 15 and resist rollers 16. By doing so, color printing is performed on both sides of the paper. The aim of the apparatus is to reduce its size. Therefore, an apparatus not requiring a change in its size has been shown in the figure as an embodiment. Although there are other methods to install a switch-back mechanism for both-side printing inside an apparatus, these require an increase in the size of the apparatus.

Figure 30:
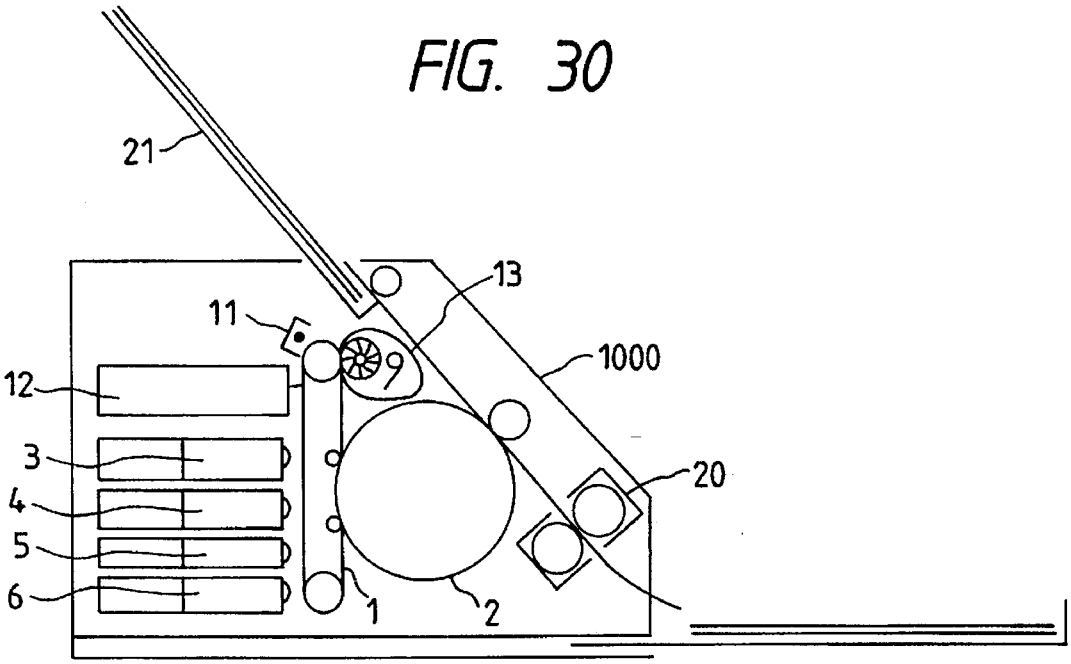
FIG. 30 is a view showing another form of paper transportation.

In the apparatus shown in FIG. 30, the paper cassette is mounted outside the apparatus, rather than inside the apparatus, when printing is performed. A sheet of paper is transported through an inclined path to be printed and fixed. In this case, the laser exposing unit 12 is arranged above the developing units and toner cassettes. Since the intermediate transfer drum 2 is arranged beside the middle portion of the photosensitive belt 1, it is necessary to provide auxiliary rollers in order to lengthen the nip between the intermediate transfer drum 2 and the photosensitive belt 1. By arranging the components in this way, it is possible to make the size of the apparatus small and to improve the printing speed owing to straightening the paper transporting path.

As described above, a color laser printer of desk-top type can be realized by employing a belt-shaped photosensitive medium arranging the photosensitive belt in a vertical direction, arranging developing units having different colors in a stack on one side of the photosensitive belt 1, arranging an intermediate transfer drum on the other side of the photosensitive belt opposite to the side on which the developing units, are provided placing the other mechanisms in positions which will decrease the apparatus size, and arranging a paper cassette, a paper transporting mechanism and so on so as to contribute to the small-size of the apparatus.

In the aforementioned embodiments, a sheet of paper is nearly straightly transported in the horizontal or inclined direction. Description will be made below on an embodiment where a the transport path is provided vertically.

Figure 31:
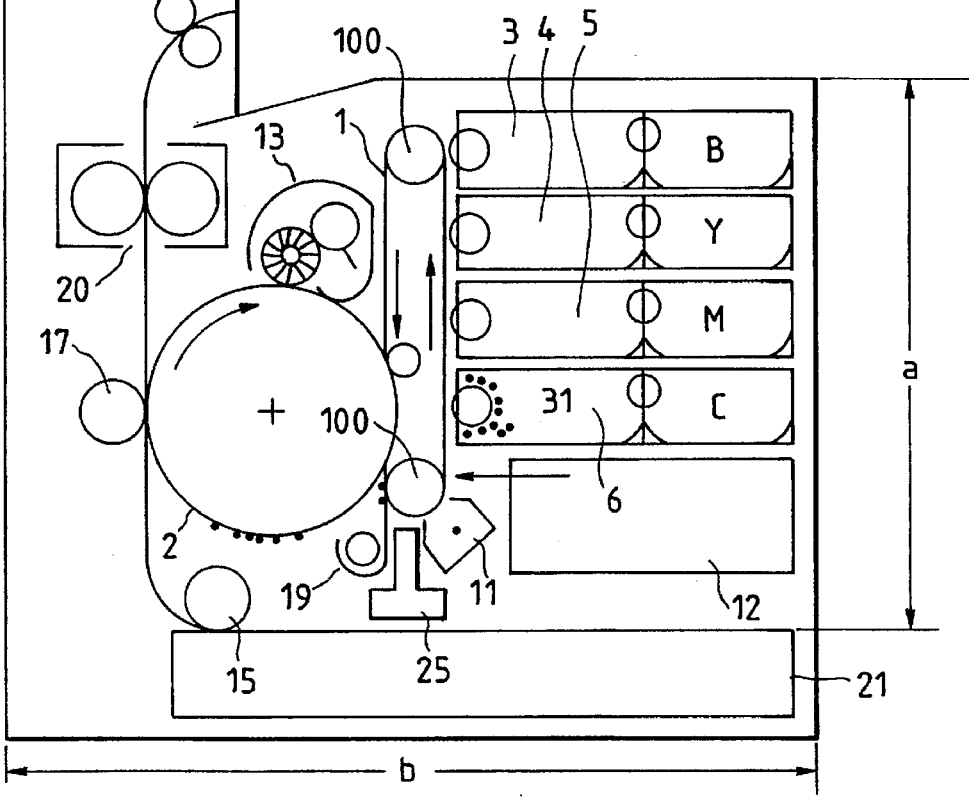
FIG. 31 is a view showing another form of paper transportation.

FIG. 31 shows the construction of another embodiment according to the present invention.

In this figure, a photosensitive belt 1 is stretched vertically similar to the apparatus of FIG. 1. Developing units 3, 4, 5, 6 are stacked vertically and arranged beside one side (in the right hand side in this embodiment) of the photosensitive belt 1. An intermediate transfer drum 2 is placed on the other side (in the left hand side in this embodiment) of the photosensitive belt 1, and a paper cassette 21 is placed under the photosensitive belt 1. A fixing unit 20 is placed above the intermediate transfer drum 2.

A sheet of paper picked-up from the paper cassette 21 with a pick-up roller 15 is transported in the vertical direction, and a toner image formed on the intermediate transfer drum 2 is transferred to the paper by a transfer roller 17 and fixed on the paper by the fixing unit 20. Then, the paper is discharged on the top of the apparatus. The photosensitive belt 1 having an organic photosensitive medium is vertically stretched over belt driving rollers 100 and is rotated in the counter-clock-wise direction. The photosensitive belt is negatively and uniformly charged by a charging unit 11. Then, a laser beam modulated by image information is irradiated from an exposing unit 12 on the photosensitive belt to form an electrostatic latent image of negative type. The electrostatic latent image is reversely developed by the developing unit 6 for cyanic toner containing cyanic toner negatively charged. The cyanic toner image formed is electrostatically transferred to the intermediate transfer drum 2. This image process is repeated for magenta toner (M), yellow toner (Y) and black toner (B) to form a full-color toner image by transfer and superposition on the intermediate transfer drum 2. This full-color toner image is transferred to a sheet of paper 7 using the transfer roller 17 subjected to a positive voltage, and is heated by the fixing unit 20 having a heat roller causing the image to be melted and fixed. Then, the paper is discharged with the printed surface facing downward on the top of the apparatus. The remaining toner not used in printing on the photosensitive belt is removed by a cleaning unit 19 having a blade. The remaining charge on the photosensitive belt is eliminated by an eraser 25. The remaining toner on the intermediate transfer drum 2 is removed by being attracted to the cleaning unit 19 having a conductive brush roller subjected to a positive voltage.

The different point in this embodiment from that of FIG. 1 is that the exposing unit 12 is placed on the same side of the belt 1 as the developing unit and the position of transferring a toner image from the intermediate transfer drum 2 is arranged so as to be in the lateral direction, not under the intermediate transfer drum 2. By arranging the components in this way, maintenance of each part can be performed easily. In this embodiment, attaching and detaching of the photosensitive belt is performed from the upside by opening the top surface, maintenance of the developing unit is performed by opening the side surface in one side (in the side arranging the developing units) and by displacing it in the horizontal direction. When paper jamming occurs, service is performed by opening the side surface in the other side (in the side of the transporting path). Therefore, there is an advantage in that attaching and detaching of the photosensitive belt or the developing units is easy and the removal of jammed paper is easy.

This construction is for transporting a laterally oriented sheets of paper of A4 size (211 mm×297 mm). The margin of the image on the photosensitive belt 1 during printing is set to approximately 70 mm. Therefore, the length per one picture is approximately 280 mm. The peripheral lengths of the photosensitive belt 1 and the intermediate transfer drum are made to agree with this length, and the diameter of the belt driving roller 100 is set to 20 mm. Thus, the distance between the center of the belt driving rollers 100 becomes 110 mm, and the diameter of the intermediate transfer drum becomes 90 mm. By closely mounting the printer composition elements, such as the developing units, the exposing unit, the fixing unit and so on around the photosensitive belt 1 and the intermediate transfer drum 2, as shown in FIG. 31, the size of the printer becomes, as shown in FIG. 31, a height of a=210 mm and a width of b=290 mm, which is nearly equal to the size of A4 paper. Therein, the size means a substantial cross-sectional size of the printer, except for the paper cassette 21 of which the size changes depending on the amount of paper therein. Therefore, the cross-sectional size of a printer for transporting a longitudinally oriented sheet of paper of A4 size is smaller than the height of 1.25 times of a and a width of 1.5 times of b because the length of the paper increases about 1.5 times, which is the aspect ratio of A4 size paper.

Figure 32:
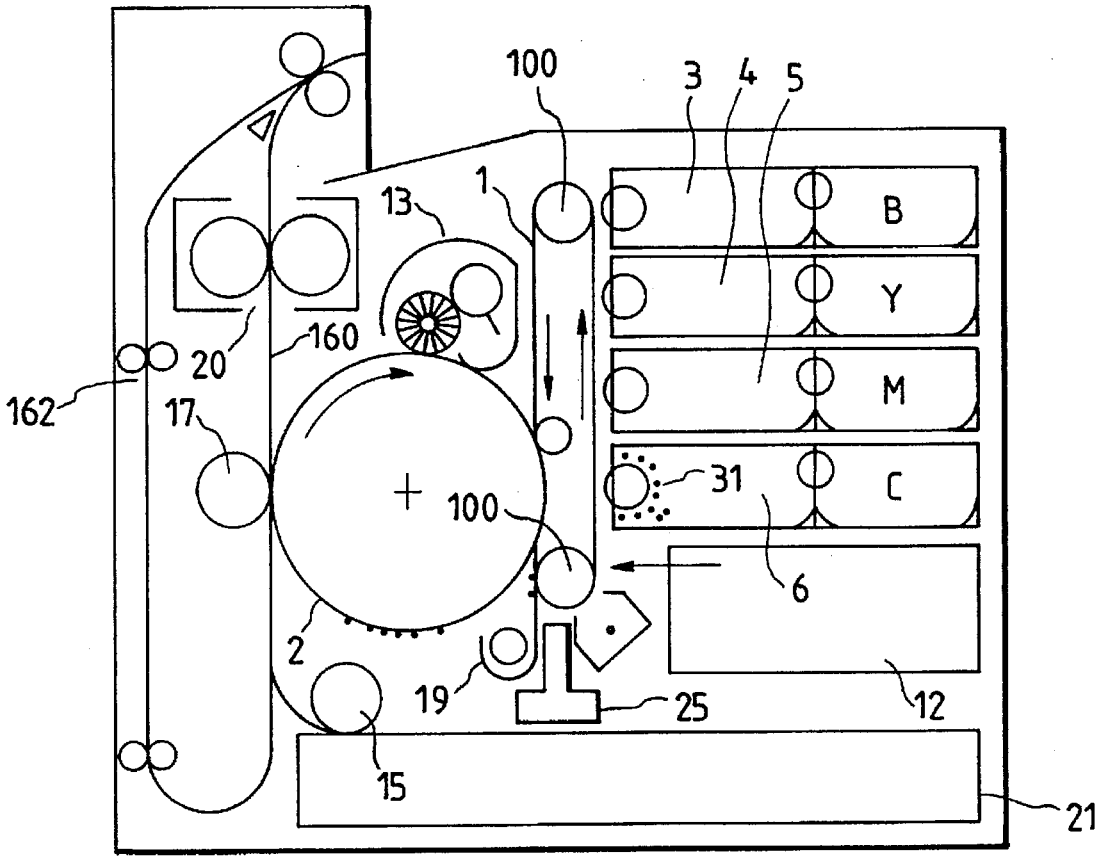
FIG. 32 is a view showing another form of paper transportation.

FIG. 32 shows another embodiment in regard to paper transportation where the construction of FIG. 31 is modified so as to perform two-sided printing by switching back the printing paper.

In the figure, a sheet of paper printed one side is not discharged after fixing, but is put between pinch rollers 150 and the pinch rollers are reversely rotated so that the paper is transported on a second transporting path 162 from the bottom side to the top side by operation of a first switch 161 for paper switching. Then, in the bottom portion of the apparatus, the transportation of the paper is reversed so that the paper is transported from the bottom side to the top side to transfer an image formed on the intermediate transfer drum to the reverse surface side of the paper using the transfer roller 17. Removal of a jammed paper is performed from the horizontal direction by opening the side surface of the apparatus, similar to the one-side printing described above. According to this embodiment, it is possible to provide an apparatus capable of performing two-sided printing without increasing apparatus size.

It is no need to say that the apparatus of FIG. 32 further includes the multi-stage paper cassette shown in FIG. 26.

As has been described, according to the present invention, it is possible to provide a small-size color laser printer which is easily usable on a desk-top which is small in size, high in image quality, and easy to maintain.

What is claimed is:

1. A small-size color electro-photographic apparatus, comprising:

a photosensitive belt;

an exposing unit for forming an electrostatic latent image by exposing said photosensitive belt;

a plurality of developing units for different color toners;

an intermediate transfer drum for successively superposing a toner image of a different color on said photosensitive belt to produce a color toner image;

a transfer unit for transferring said color toner image superposed on said intermediate transfer drum to a printing medium; and a fixing unit for fixing the color toner image transferred onto the printing medium;

wherein an outer peripheral length of said photosensitive belt is nearly equal to and not longer than an outer peripheral length of said intermediate transfer drum, said photosensitive belt being stretched in a vertical direction parallel to the direction of gravity, the developing units for different colors being vertically stacked on one side of the photosensitive belt and said intermediate transfer drum being arranged on another side of the photosensitive belt.

2. A small-size color electro-photographic apparatus according to claim 1, wherein:

a charging unit, the exposing unit, a cleaner for cleaning the photosensitive belt and said intermediate transfer drum are arranged on the side of the photosensitive belt opposite to the side where said plurality of developing units are arranged.

3. A small-size color electro-photographic apparatus according to claim 2, wherein:

a diameter of said intermediate transfer drum is 70 to 150 mm.

4. A small-size color electro-photographic apparatus according to claim 2, wherein:

said cleaner for the photosensitive belt has a brush cleaning mechanism composed of a conductive brush subjected to a voltage, a metallic roller subjected to a voltage and a scrubbing blade for the metallic roller.

5. A small-size color electro-photographic apparatus according to claim 1, wherein:

a belt-to-belt span in a parallel portion of the photosensitive belt in a developing apparatus is 25 to 65 mm, and a developing roll, a stirring chamber or feeding roll, and a toner containing chamber are arranged in a direction perpendicular to and extending from a surface of a photosensitive belt in that order.

6. A small-size color electro-photographic apparatus according to claim 1, wherein:

an outer peripheral length of a roller supporting said photosensitive belt is an integer of the outer peripheral length of said photosensitive belt.

7. A small-size color electro-photographic apparatus according to claim 1, wherein:

said exposing unit is a laser exposing system which scans a laser beam using a polygon mirror, comprising at least one reflecting mirror having a fθ characteristic to correct a position between the laser beam reflected by said polygon mirror and the photosensitive belt being exposed by said reflected beam being exposed by said reflected beam.

8. A small-size color electro-photographic apparatus according to claim 7, wherein:

said reflecting mirror is formed by applying aluminum vapor deposition to a plastic material.

9. A small-size color electro-photographic apparatus according to claim 1, wherein:

said exposing unit is constructed by an optical system which scans a laser beam using a polygon mirror, comprising a multi-folding mirror unit and correcting means for correcting at least one of a fluctuation in an amount of light and distortion in the light due to said multi-folding mirror unit.

10. A small-sized color electro-photographic apparatus according to claim 1, wherein:

at least one of said plurality of developing units includes a developing roll, a stirring chamber for mixing toner received from the roll, and a feeding roll for feeding toner from said stirring chamber to a toner-containing chamber, said developing roll, stirring chamber, feeding roll, and toner-containing chamber being arranged in that order substantially along an axis extending in a direction perpendicular to and a predetermined distance from a surface of said photosensitive belt, and said at least one of said plurality of developing units has a size in a vertical direction which lies in a range between 25 to 65 mm.

11. A small-sized color electro-photographic apparatus according to claim 10, wherein each one of said plurality of developing units has a size in a vertical direction which lies in a range between 25 to 65 mm.

12. A small-size color electro-photographic apparatus comprising:

a photosensitive belt;

an exposing unit for forming an electrostatic latent image by exposing said photosensitive belt;

a plurality of developing units for different color toners;

an intermediate transfer drum for successively superposing a toner image of a different color on said photosensitive belt to produce a color toner image;

a transfer unit for transferring said color toner image superposed on said intermediate transfer drum to a printing medium; and a fixing unit for fixing the color toner image transferred onto the printing medium;

wherein an outer peripheral length of said photosensitive belt is nearly equal to and not longer than an outer peripheral length of said intermediate transfer drum, said photosensitive belt being stretched in a vertical direction parallel to the direction of gravity, the developing units for different colors being vertically stacked on one side of the photosensitive belt and said intermediate transfer drum being arranged on another side of the photosensitive belt;

wherein a diameter of said intermediate transfer drum is 70 to 150 mm.

13. A small-size color electro-photographic apparatus according to claim 12, wherein:

the photosensitive belt which is vertically arranged and the developing units arranged on one side of the photosensitive belt are formed in a unit;

each of the developing units in said unit is provided with a cam mechanism for changing a contact gap between the developing unit and the photosensitive belt;

the developing units placed closest to the ends of the belt are arranged in such positions that centers of a developing rolls provided in the developing units come to a flat surface side of the photosensitive belt from a center of a roller inside the photosensitive belt; and restricting members for restricting a position of the photosensitive belt are provided on an inner side of a surface of the photosensitive belt facing the developing units, each at positions where the developing rolls of the developing units are contacting the photosensitive belt.

14. A small-size color electro-photographic apparatus according to claim 12, wherein:

the photosensitive belt which is vertically arranged and the developing units arranged on one side of the photosensitive belt are formed in a unit;

each of the developing units in said unit is provided with a cam mechanism for changing a contact gap between the developing unit and the photosensitive belt;

the developing unit placed closest to the ends of the belt are arranged in such positions that centers of developing rolls provided in the developing units come to a flat surface side of the photosensitive belt from a center of a roller inside the photosensitive belt; and restricting members for restricting a position of the photosensitive belt are provided on an inner surface of the photosensitive belt facing the developing units, each of said restricting members being arranged relative to said developing units so as to be disposed between a pair of developing rolls contacting the photosensitive belt.

15. A small-size color electro-photographic apparatus having a photosensitive belt, an exposing unit for forming an electrostatic latent image by exposing said photosensitive belt, a plurality of developing units for different colors, an intermediate transfer drum for successively superposing a toner image of a different color on said photosensitive belt to produce a color toner image, a transfer unit for transferring said color image superposed on said intermediate transfer drum to a printing medium, a fixing unit for fixing the color image transferred onto the printing medium, and a case containing a controller for controlling each of the units, wherein:

an outer peripheral length of said photosensitive belt is nearly equal to and not longer than an outer peripheral length of said intermediate transfer drum;

said photosensitive belt is stretched in a vertical direction parallel to the direction of gravity;

the developing units for different colors are vertically stacked on one side of the photosensitive belt and said intermediate transfer drum is arranged on another side of the photosensitive belt;

said photosensitive belt and the developing units arranged on one side of the photosensitive belt are formed in a unit;

each of the developing units in said unit being linked to a cam mechanism for changing a contact gap between the developing unit and the photosensitive belt for each of the developing units so that each of the developing units contacts or approaches the photosensitive belt one-by-one according to a control signal from said controller when the developing units in said unit are mounted in said case.

16. A small-size color electro-photographic apparatus having a photosensitive belt, an exposing unit for forming an electrostatic latent image by exposing said photosensitive belt, a plurality of developing units for different colors, an intermediate transfer drum for successively superposing a toner image of a different color on said photosensitive belt to produce a color toner image, a transfer unit for transferring said color image superposed on said intermediate transfer drum to a printing medium, a fixing unit for fixing the color image transferred onto the printing medium, and a case containing a controller for controlling each of the units, wherein:

the photosensitive belt is generally vertically oriented and the developing units are arranged on one side of the photosensitive belt and are formed in a unit;

each of the developing units in said unit being provided with a cam mechanism for changing a contact gap between the developing unit and the photosensitive belt;

at least one of the developing units disposed at respective ends of the belts is arranged at such a position that a center of a developing roll provided in the developing unit coincides with a center of a roller over which the photosensitive belt passes; and guide members for stably holding a position of the photosensitive belt are provided in an inner side of a surface of the photosensitive belt facing the developing units arranged intermediate the developing units disposed at the respective ends of the belt.

17. A small-size color electro-photographic apparatus having a photosensitive belt which is vertically oriented; a plurality of developing units stacked beside one side surface of said photosensitive belt; a fixing unit placed under said plurality of developing units; a paper cassette placed under said fixing unit; an intermediate transfer drum placed in a lower side portion adjacent the other side surface of said photosensitive belt; a photosensitive belt cleaner having an erase lamp mounted in a cabinet, a charging unit and an exposing unit placed in this order above said intermediate transfer drum; a transfer roller placed under said intermediate transfer drum; and a paper transporting path on which a sheet of paper is transported from said transfer roller to the fixing unit.

18. A small-size color electro-photographic apparatus according to claim 17, wherein:

a diameter of said intermediate transfer drum is 70 to 150 mm;

said photosensitive belt is a loop-shaped belt and a belt-to-belt span in a parallel portion of the photosensitive belt in a developing apparatus is 25 to 65 mm; and a developing roll, a stirring chamber or feeding roll, and a toner containing chamber are arranged in a direction perpendicular to and extending from the surface of said photosensitive belt in that order.

19. A small-sized color electro-photographic apparatus according to claim 17, wherein:

a diameter of said intermediate transfer drum is 70 to 150 mm, and at least one of said plurality of developing units includes a developing roll, a stirring chamber for mixing toner received from the roll, and a feeding roll for feeding toner from said stirring chamber to a toner-containing chamber, said developing roll, stirring chamber, feeding roll, and toner-containing chamber being arranged in that order substantially along an axis extending in a direction perpendicular to and a predetermined distance from a surface of said photosensitive belt.

20. A small-size color electro-photographic apparatus having a loop shaped photosensitive belt which is vertically oriented, a plurality of developing units stacked beside one side surface of said photosensitive belt; an intermediate transfer drum placed diagonally below the other side of said photosensitive belt; a fixing unit placed above said intermediate transfer drum; and a paper cassette placed under said photosensitive belt.

21. A small-size color electro-photographic apparatus according to claim 20, wherein:

a sheet of paper picked from said paper cassette is vertically transported after having a color toner image transferred thereto from said intermediate transfer drum, said sheet of paper being discharged to an upper portion of the electro-photographic apparatus after said color toner image is fixed.

22. A small-size color electro-photographic apparatus according to claim 20, further comprising:

a vertical transporting path, beneath said intermediate transfer drum, for transporting a sheet of paper to a position where said intermediate transfer drum can transfer a first superposed image to a first side of said paper;

a further transporting path, substantially parallel to said vertical transporting path, for returning said paper to the vertical transporting path, said further transporting path merging with said vertical transporting path; and switching means, disposed at an area where said vertical transporting path merges with said further transporting path, for switching said paper from said vertical transporting path to said further transporting path, whereupon said further transporting path returns said paper to said vertical transporting path, so that said paper is transported to a position where said intermediate transfer drum can transfer a second superposed image to a second side of said paper.

23. A small-sized electro-photographic apparatus according to claim 20, further comprising:

an exposing unit, disposed beneath said plurality of developing units, for exposing said photosensitive belt.

24. A small-sized color electro-photographic apparatus comprising:

a loop-shaped photosensitive belt which is vertically stretched;

a plurality of developing units stacked on one side of said photosensitive belt;

an intermediate transfer drum placed on another side of said photosensitive belt;

a fixing unit placed above said intermediate transfer drum;

an exposing unit placed under said developing units; and a paper cassette placed under said photosensitive belt and exposing unit.

25. A small-sized color electro-photographic apparatus according to claim 24, comprising:

a color toner image transfer unit disposed approximately on a side of said intermediate transfer drum opposite to, with respect to a center of rotation of said drum, a position at which said intermediate transfer drum contacts said photosensitive belt, said color toner image transfer unit directly transferring a color toner image from said intermediate transfer drum to a sheet of paper fed from said paper cassette and then transporting said sheet of paper to said fixing unit.

* * * * *